US010267089B2

(12) United States Patent
Richardson

(10) Patent No.: US 10,267,089 B2
(45) Date of Patent: Apr. 23, 2019

(54) TOP DRIVE COUPLING FOR DRILLING

(71) Applicant: Warrior Rig Technologies Limited, Calgary (CA)

(72) Inventor: Allan Richardson, The Woodlands, TX (US)

(73) Assignee: Warrior Rig Technologies Limited, Calgary (CA)

( * ) Notice: Subject to any disclaimer, the term of this patent is extended or adjusted under 35 U.S.C. 154(b) by 902 days.

(21) Appl. No.: 14/613,104

(22) Filed: Feb. 3, 2015

(65) Prior Publication Data

US 2015/0217974 A1 Aug. 6, 2015

Related U.S. Application Data

(60) Provisional application No. 61/935,322, filed on Feb. 3, 2014.

(51) Int. Cl.
*B66C 1/34* (2006.01)
*E21B 3/02* (2006.01)
*E21B 19/02* (2006.01)

(52) U.S. Cl.
CPC ..... *E21B 3/02* (2013.01); *B66C 1/34* (2013.01); *E21B 19/02* (2013.01); *Y10T 403/32893* (2015.01); *Y10T 403/32918* (2015.01); *Y10T 403/7098* (2015.01)

(58) Field of Classification Search
CPC ... B66C 1/34; E21B 3/02; E21B 17/02; E21B 17/023; E21B 17/026; E21B 19/02; E21B 19/04; E21B 33/038; F16B 7/18; F16B 7/22; F16B 9/02; F16B 9/026; Y10T 403/16; Y10T 403/32893; Y10T 403/32901; Y10T 403/32909; Y10T 403/32926; Y10T 403/46; Y10T 403/4605; Y10T 403/4648; Y10T 403/598; Y10T 403/7098; Y10T 403/7182; Y10T 403/7188
USPC ..... 403/11, 154–157, 230, 232.1, 247, 324, 403/383, 398, 399
See application file for complete search history.

(56) References Cited

U.S. PATENT DOCUMENTS 3,463,521 A * 8/1969 Helton ..... E02F 9/006 299/109
4,096,957 A * 6/1978 Iverson ..... E02F 3/3604 403/154
4,221,364 A * 9/1980 Nishimura ..... B66D 3/16 24/116 R
4,243,341 A * 1/1981 Kabay ..... F16C 11/02 403/158

(Continued)

OTHER PUBLICATIONS

Boron Nitride Coatings—Features and Applications of BN Coatings by Precision Ceramics. Precision Ceramics. Nov. 16. 2008.*

*Primary Examiner* — Josh Skroupa
(74) *Attorney, Agent, or Firm* — Oyen Wiggs Green & Mutala LLP

(57) ABSTRACT

A coupling may be used to couple a top drive to a traveling block in a drilling rig. The coupling comprises a beam that is movable between a retracted configuration in which a becket or bail may be passed behind the beam to a closed configuration in which the beam is linked behind the becket or bail. The beam may include a compound curvature contact area that mates with a corresponding contact area of the becket or bail. The coupling may be remotely actuated.

31 Claims, 21 Drawing Sheets

(56) References Cited

U.S. PATENT DOCUMENTS

| | | | | | |
|---|---|---|---|---|---|
| 4,251,182 | A * | 2/1981 | Schroeder | B62D 55/0887 | 384/276 |
| 4,549,829 | A * | 10/1985 | Springer | B66C 1/34 | 403/57 |
| 5,148,718 | A * | 9/1992 | Kakuguchi | G05G 1/12 | 403/383 |
| 5,722,784 | A * | 3/1998 | Link | B60G 7/008 | 280/93.512 |
| 6,322,280 | B1 * | 11/2001 | Coyne | E02F 9/006 | 403/154 |
| 7,070,331 | B2 * | 7/2006 | Schaffer | E02F 9/006 | 384/130 |
| 7,461,996 | B2 * | 12/2008 | Kinme | F16D 3/387 | 403/232.1 |
| 7,717,689 | B2 * | 5/2010 | Sato | F04C 2/084 | 403/383 |
| 8,333,528 | B2 * | 12/2012 | Oertley | F16J 15/344 | 37/466 |
| 9,290,198 | B2 * | 3/2016 | Doerr | B62D 1/20 | |
| 9,863,455 | B2 * | 1/2018 | Green | F16B 19/002 | |
| 2001/0007625 | A1 * | 7/2001 | Moon | F16D 1/0864 | 403/158 |
| 2010/0127149 | A1 * | 5/2010 | Kaybidge | E21B 19/02 | 248/637 |
| 2013/0313806 | A1 * | 11/2013 | Hansen | F16C 33/7886 | 280/515 |

* cited by examiner

TOP DRIVE COUPLING FOR DRILLING

CROSS-REFERENCE TO RELATED APPLICATIONS

This application claims priority to U.S. Provisional Patent Application No. 61/935,322 entitled TOP DRIVE COUPLING FOR DRILLING, filed 3 Feb. 2014, which is incorporated herewith in its entirety.

TECHNICAL FIELD

This invention relates to heavy lifting, particularly to apparatus and methods for coupling together elements in overhead lifting. The invention has application in drilling, particularly on-shore or offshore drilling into the earth for recovering petrochemicals, exploration or research. Some embodiments have particular application in coupling top drives to overhead lifting equipment.

BACKGROUND

A prior art drill rig 10 of the general type used for drilling is illustrated in FIG. 1. Drill rig 10 includes a derrick 11 located over a well head 13 and a hoist identified generally as 12 for supporting and lifting a drill string. In the illustrated embodiment, hoist 11 comprises a draw works 12A which is connected to lift a travelling block 12B by a cable 12C which extends over a crown pulley 12D. Draw works 12A can be operated to raise or lower travelling block 12B.

Travelling block 12B is coupled to a top end of a drill string 14 made up of tubular sections 14A. Drill string 14 may be many thousands of feet long. Consequently, hoist 12 must have a very large capacity. Travelling blocks having rated capacities of 250 to 750 tons are not unusual. Components coupling the travelling block to the drill string have similar capacities.

In a traditional drill rig, the drill string is rotated by a rotary table driving a kelly coupled to the top end of the drill string. An upper end of the kelly is coupled to the traveling block by a swivel. Overhead equipment connections used for kelly/swivel/rotary table operations use a traveling block equipped with a hook. The hook can easily be connected to and disconnected from the swivel for drilling and may also support elevator links for tripping. Travelling block—hook connections are made up semi-permanently since it is not generally necessary to disconnect the hook from the traveling block for rig moves.

Most travelling blocks, especially in the larger sizes (e.g. >250 ton capacity), connect to hooks using a becket connection. A becket is a beam which is pinned at either end to the traveling block. Hooks include a member which passes over the becket. Both sides of the interface between the hook and the becket have complementary compound curvatures. There are industry standards (API 8C—Specification for Drilling and Production Hoisting Equipment (PSL 1 and PSL 2), currently in its Fifth Edition) which prescribe compound contact curvatures for becket connections in overhead equipment. These API standards ensure compatibility of components across the industry.

FIG. 2A shows a typical travelling block 20 which includes a becket 22 having ends 22A and 22B coupled to the main body of traveling block 20 by pins 24. A central area 22C of becket 22 has a compound curvature for providing good contact with a hook. FIG. 2B shows a typical hook 26 which includes a bail 28 designed to pass over becket 22 of traveling block 20. Bail 28 has ends 28A and 28B pinned to the main body of hook 26 and a central region 28C which has a compound curvature complementary to that of central region 22C of becket 22.

An alternative way to rotate a drill string is by way of a top drive. Top drives are becoming preferred over kelly/rotary table drives for many drilling operations. A top drive couples to the traveling block and directly drives a top end of the drill string. When a top drive (TD) is used, a hook is neither required nor desirable. A hook adds length, weight, cost, and maintenance. It is therefore common to connect top drives directly to the traveling block, without a hook.

A top drive must typically be disconnected from the travelling block for rig moves, rig up and sometimes also for maintenance. To achieve this it has been necessary to unpin one end of the becket on the traveling block, slide a member of the top drive over the becket and then reinstall the becket. This is difficult and potentially dangerous work that is often performed 20 feet or more above the rig floor without a proper work platform. The components are heavy and can be seized in place by corrosion. To give a sense of scale, a becket pin (removal required for rig up), from a typical 500 ton capacity traveling block, weighs approximately 70 lbs. (30 kg). The becket itself, for a typical 500 ton capacity traveling block, weighs about 750 lbs, (about 350 kg), far beyond human lifting capacity for even one end. Becket pins are typically removed using a hammer and punch bar (a 2 man operation). Once the becket pin is removed, there is no good way to lift the becket—no lifting eyes for winch attachment.

In some cases, the travelling block must be pulled to one side or another to engage the top drive. In such circumstances the becket often does not have enough room to cleanly swing under the bail of the top drive. Coupling the top drive to the traveling block in such circumstances can require moving the top drive to the side and, in coordination with that movement, lifting the becket to engage under the bail of the top drive.

There is a need for a better way to couple components of hoisting equipment used in drilling operations, particularly to couple top drives to traveling blocks. Preferably in a way that provides compatibility with legacy equipment. Preferably in a way that provides some angular flexibility.

SUMMARY

This invention has a number of aspects. One aspect provides top drives equipped for coupling to the becket of a traveling block. One aspect provides methods for coupling top drives to traveling blocks. One aspect provides a coupling assembly for coupling a top drive to a traveling block. One aspect provides a top drive equipped with a coupling for engaging a becket of a traveling block in a drill rig. One aspect provides a coupling useful in heavy lifting or pulling. The coupling may be used to couple together various elements.

One example aspect provides a coupling useful for coupling a top drive to overhead lifting equipment such as a traveling block in a drill rig. The coupling comprises a first member spaced apart from a second member by a gap dimensioned to receive a coupling member such as a becket between them. The first and second members may, for example, comprise arms attached to a top drive or to the overhead lifting equipment. A beam is supported in an aperture proximate an end of the first member. The second member has an aperture or recess dimensioned to receive a first end of the beam. The beam is movable longitudinally between a closed configuration wherein the beam spans the gap with the first end of the beam engaged in the aperture or recess on the second member and a retracted configuration wherein the first end of the beam is spaced apart from the second member. The coupling member is insertable into the gap when the beam is in the retracted configuration. The traveling block and the overhead equipment can be coupled together by moving the beam to the closed configuration. The beam has a non-circular cross section (e.g. obround, rectangular with rounded corners, oval, elliptical or the like) wherein a depth of the beam is greater than a thickness of the beam. The beam is held against rotation, at least when in the closed configuration. For example, the aperture of the first member and/or the aperture or recess of the second member may conform at least in part to the cross section of the beam and thereby prevent rotation of the beam. The beam and coupling member cross one another (for example at a 90 degree angle) when the coupling is made up.

In some embodiments the beam comprises a depth to thickness ratio of at least 1.5 to 1. The beam comprises a contact area configured to engage a corresponding contact surface of the becket. For example, the contact area may be a saddle-shaped contact area having surface curvatures as specified by API standard 8C. The contact area lies within the cross-section of the beam in some embodiments. The coupling may comprise one or more guide surfaces configured to bear against the beam to maintain the beam in alignment with the aperture or recess of the second member.

A force amplifying mechanism may be provided to slide the beam relative to the first and second members. In some embodiments the force amplifying mechanism comprises a screw and the beam comprises an opening into which the screw is threadedly engageable. In one embodiment the force amplifying mechanism comprises first and second screws respectively extending longitudinally along first and second sides of the beam. Each of the first and second screws is coupled to rotate relative to the beam and first and second half-nuts supported relative to the first member and respectively engaging the first and second screws.

The beam may be actuated by an actuation mechanism such as a linear actuator, a rack and pinion mechanism, rack and worm mechanism, a hydraulic or pneumatic piston, and a lever. A remote control mechanism may be provided for operating the actuation mechanism.

In some embodiments the beam comprises an arcuate beam and the arcuate beam is actuated in a curved path extending between the aperture of the first member and the aperture or recess of the second member. In some embodiments insertion of the becket actuates the movement of the beam from the retracted configuration to the closed configuration.

Couplings may be provided to support loads of 250 tons or more. A yield strength of the beam may be at least 110 kpsi. The beam may have an impact toughness of at least 31 ft-lb (42 J) at −40° F. (−40° C.) average. The beam may be coated with a nitride layer.

Another aspect provides a coupling useful in overhead lifting. The coupling comprises a first member spaced apart from a second member by a gap dimensioned to receive a coupling member between them. The coupling member may be a becket, but is not so limited. A beam is supported in an aperture proximate an end of the first member and the second member has an aperture or recess dimensioned to receive a first end of the beam. The beam is movable longitudinally (for example by sliding) between a closed configuration wherein the beam spans the gap with the first end of the beam engaged in the aperture or recess on the second member and a retracted configuration wherein the first end of the beam is spaced apart from the second member. The coupling member is insertable into the gap when the beam is in the retracted configuration and the coupling member retained in the gap by the beam when the beam is in the closed configuration. The beam has a non-circular cross section wherein a depth of the beam is greater than a thickness of the beam. The beam is held against rotation relative to the first and second members. Such a coupling may be used to couple a top drive to a traveling block or other overhead lifting equipment but also has other applications.

Another aspect provides a method for coupling a top drive to a traveling block in a drill rig. The top drive is coupled to a first member spaced apart from a second member by a gap dimensioned to receive a coupling member such as a becket between them. The method comprises: providing a beam supported in an aperture proximate an end of the first member and dimensioned to contact an aperture or recess dimensioned to receive a first end of the beam; and actuating the beam to move from a retracted configuration in which the becket is insertable into the gap to a closed configuration in which the beam spans the gap with the first end of the beam engaged in the aperture or recess on the second member such that the travelling block and the top drive are coupled together. The beam has a non-circular cross section and is held against rotation. For example, at least one of the aperture of the first member and the aperture or recess of the second member may conform at least in part to the cross section of the beam and thereby restrict rotation of the beam in the apertures.

Another aspect provides a method for coupling in overhead lifting. The method comprises: providing first and second members attached to a first element and a beam supported in an aperture proximate an end of the first member. The beam is dimensioned to extend from the first member to contact an aperture or recess in the second member. The aperture or recess in the second member is dimensioned to receive a first end of the beam. The method actuates the beam to move from a retracted configuration in which a coupling member attached to a second element to be coupled to the first element is insertable into the gap to a closed configuration in which the beam spans the gap with the first end of the beam engaged in the aperture or recess on the second member such that the first and second elements are coupled together. The beam has a non-circular cross section and the method holds the beam against rotation relative to the first and second members.

Apparatus and methods as described herein have particular application in heavy lifting (e.g. for design loads of 50 tons plus an appropriate safety factor or more).

Further aspects and example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
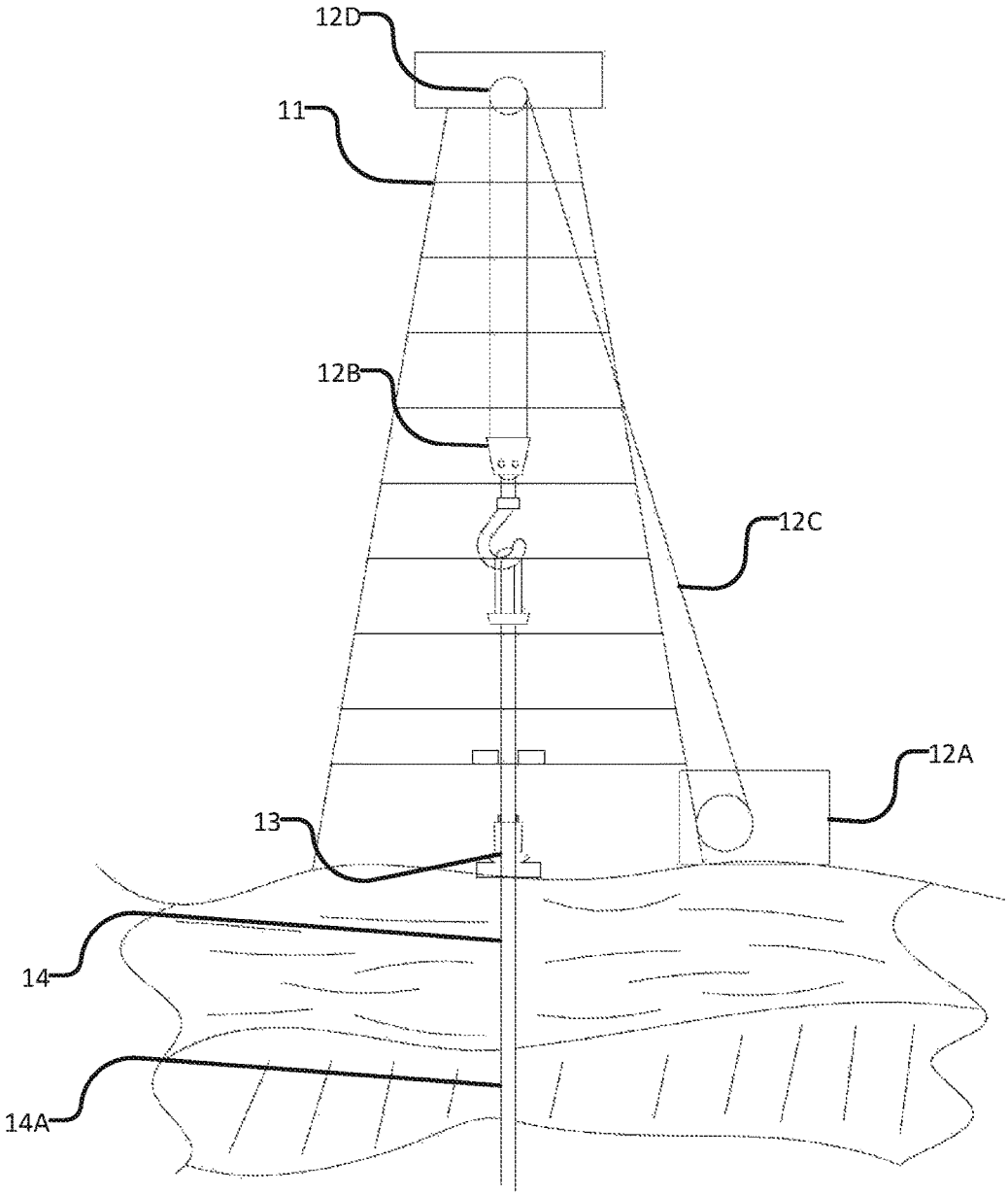
FIG. 1 PRIOR ART
FIG. 1 shows schematically a prior art drilling rig.
Figure 2A:
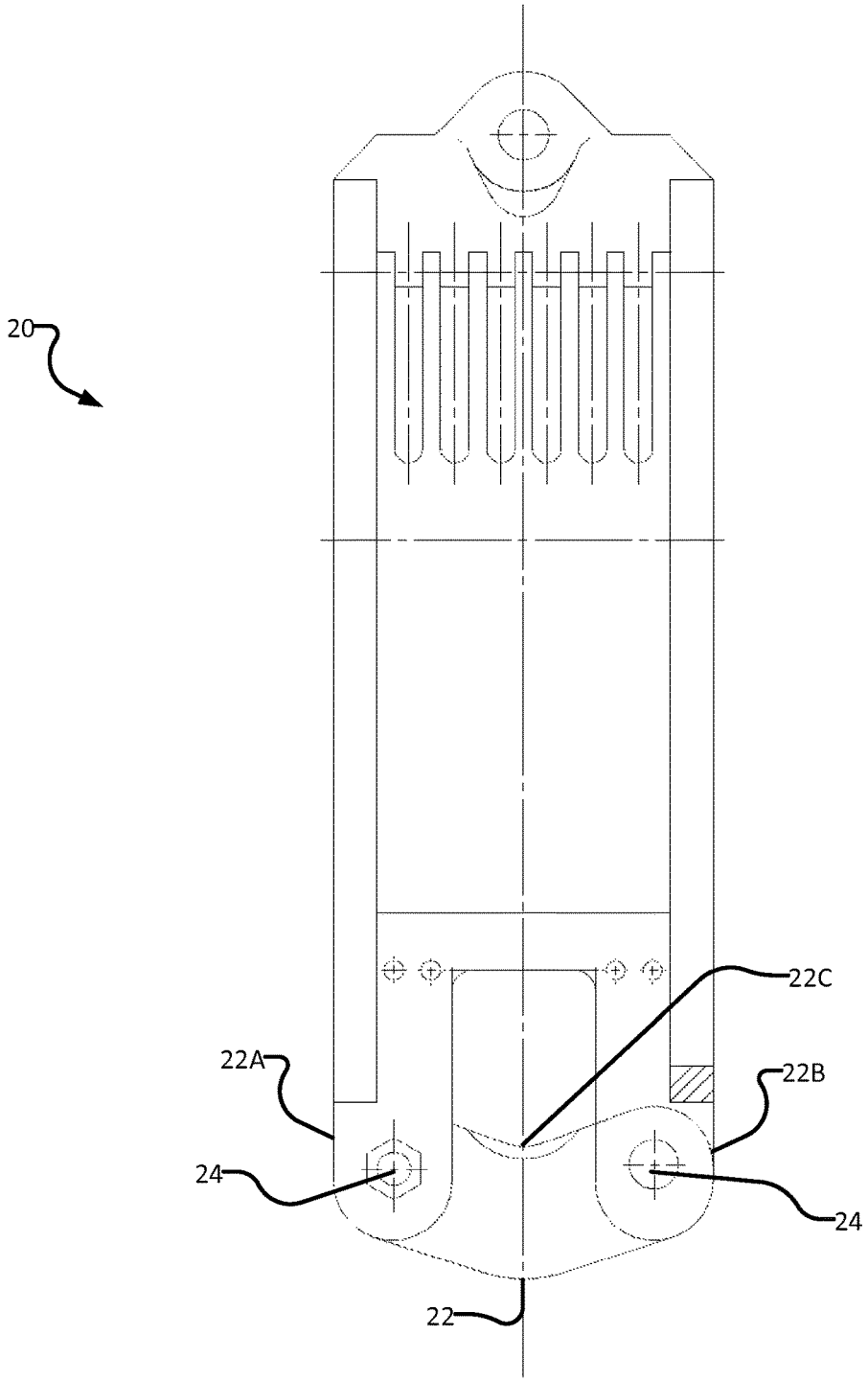
FIG. 2A (PRIOR ART)
FIG. 2A is a front elevation view of a prior art traveling block.
Figure 2B:
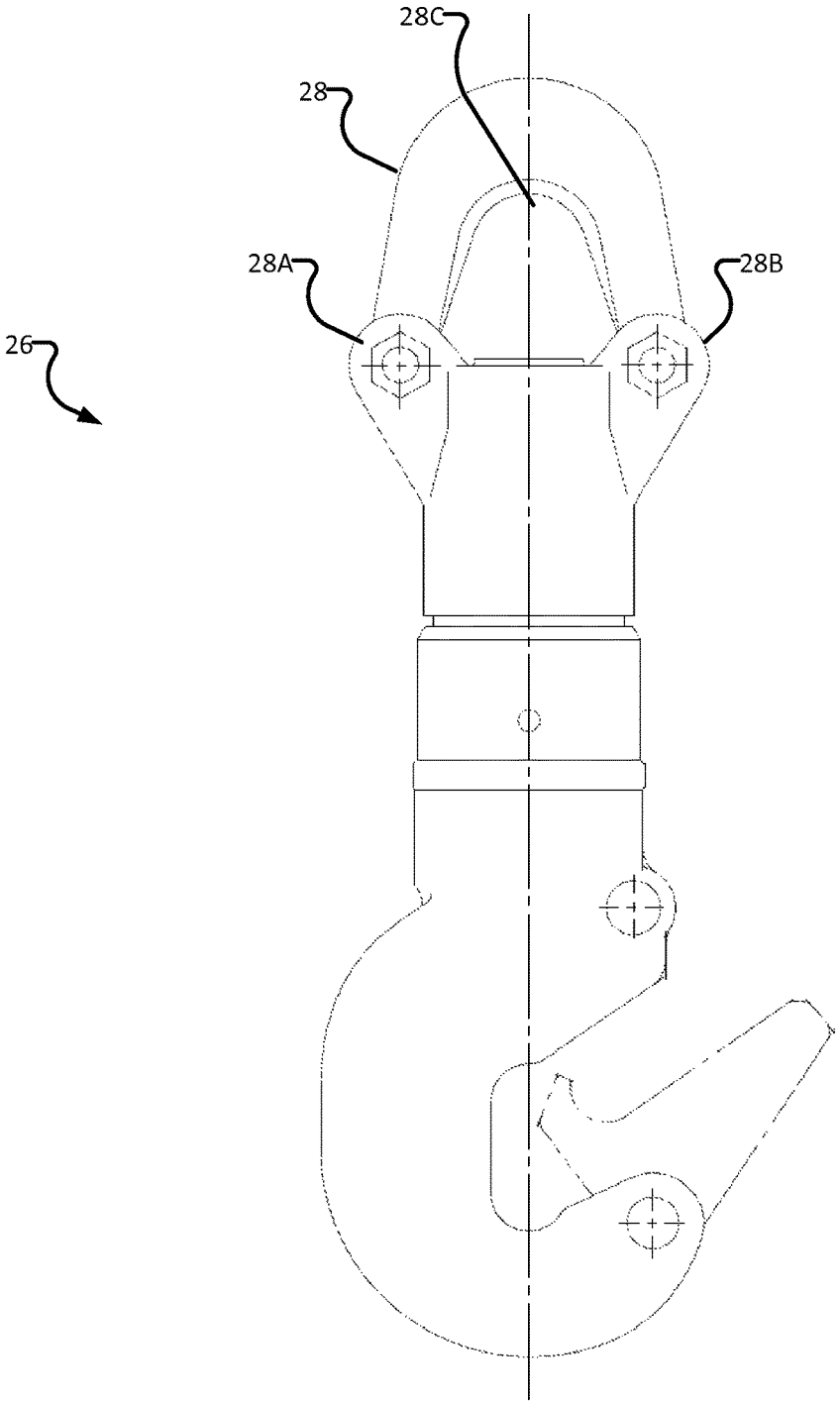
FIG. 2B (PRIOR ART)
FIG. 2B is a side elevation view of a prior art hook.
Figure 3:
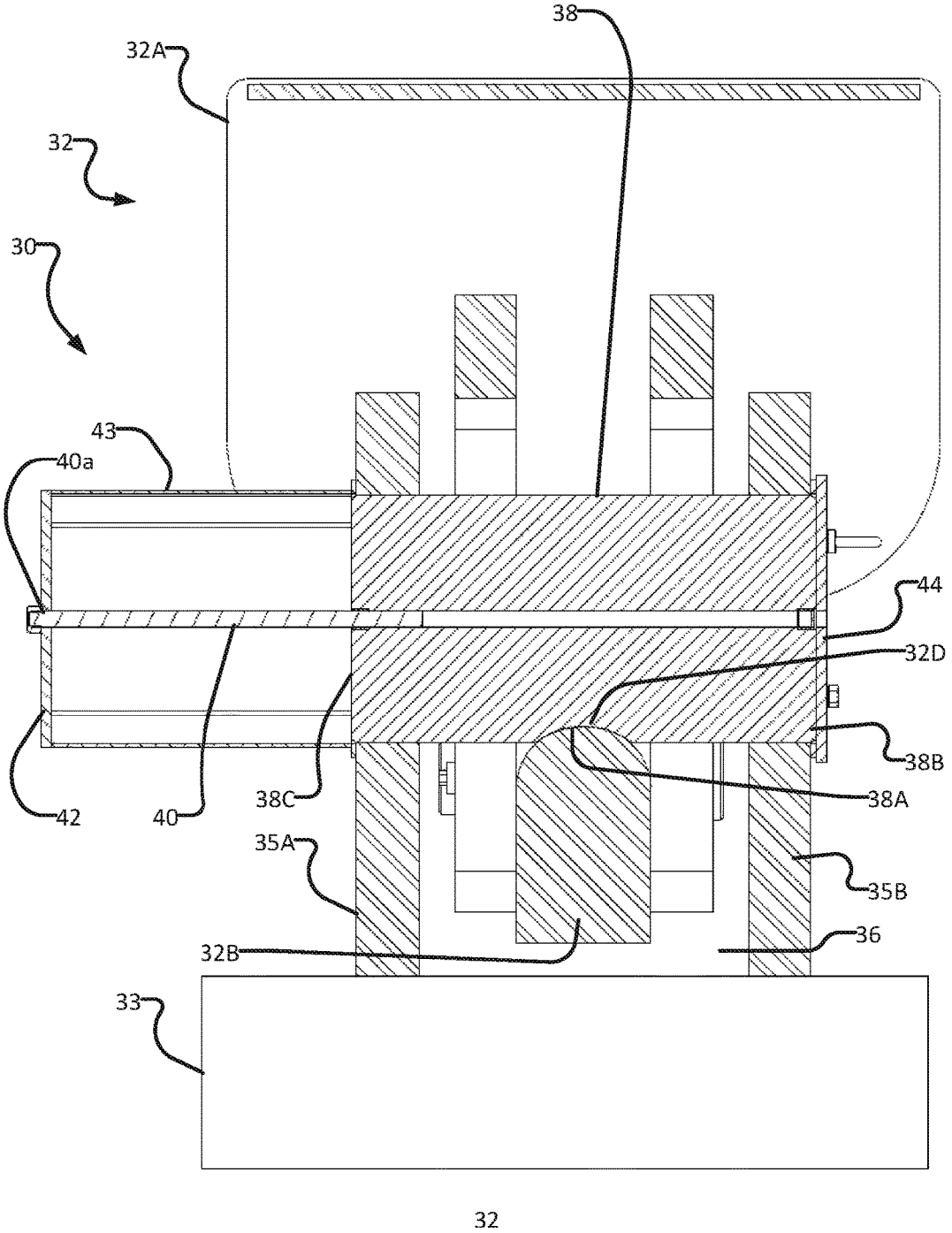
FIG. 3 is a cross-section view of a coupling according to an example embodiment with a moving beam in a closed configuration.
Figure 3A:
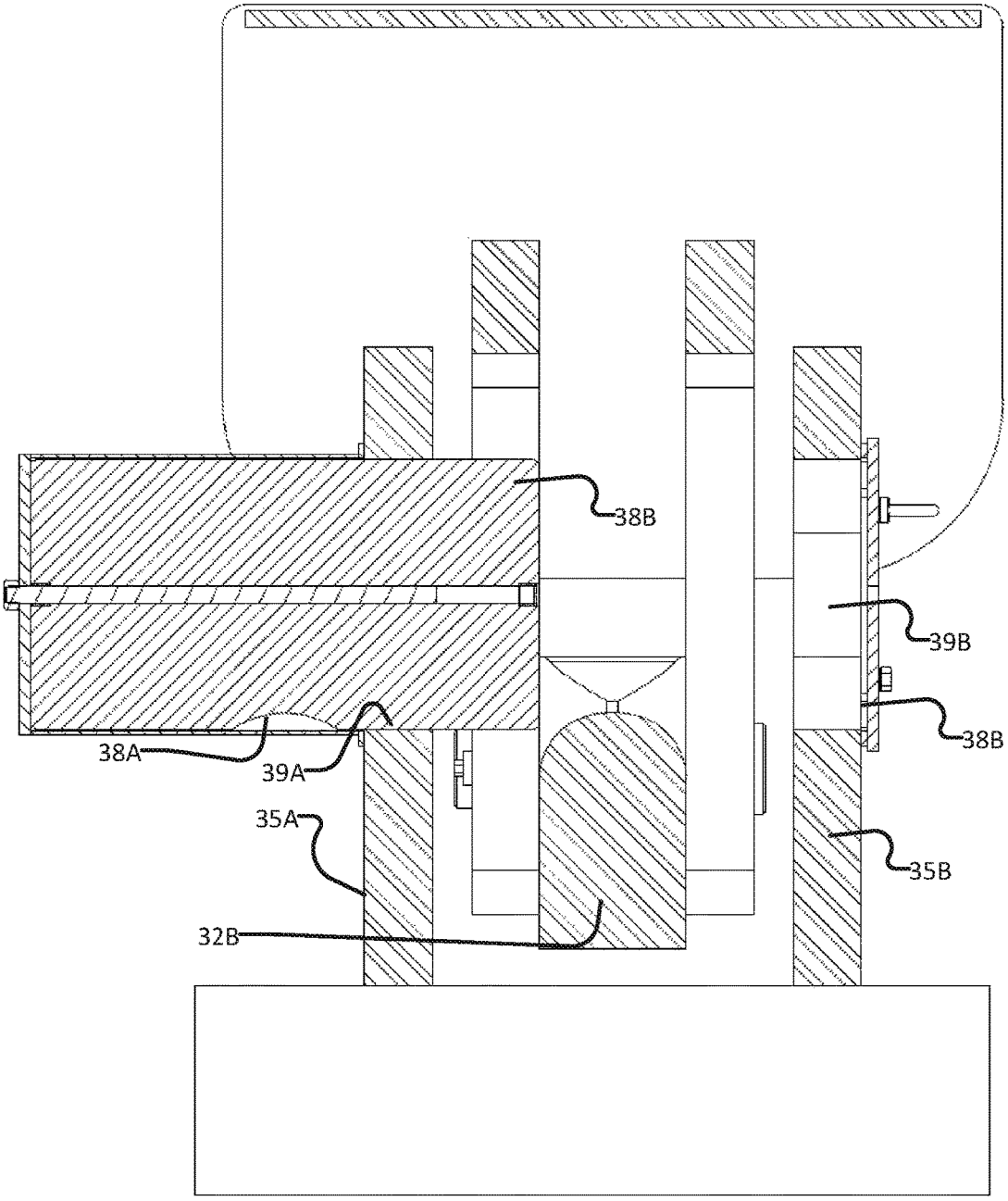
FIG. 3A is a cross section view of the coupling of FIG. 3 with the moving beam in a retracted configuration.
Figure 3B:
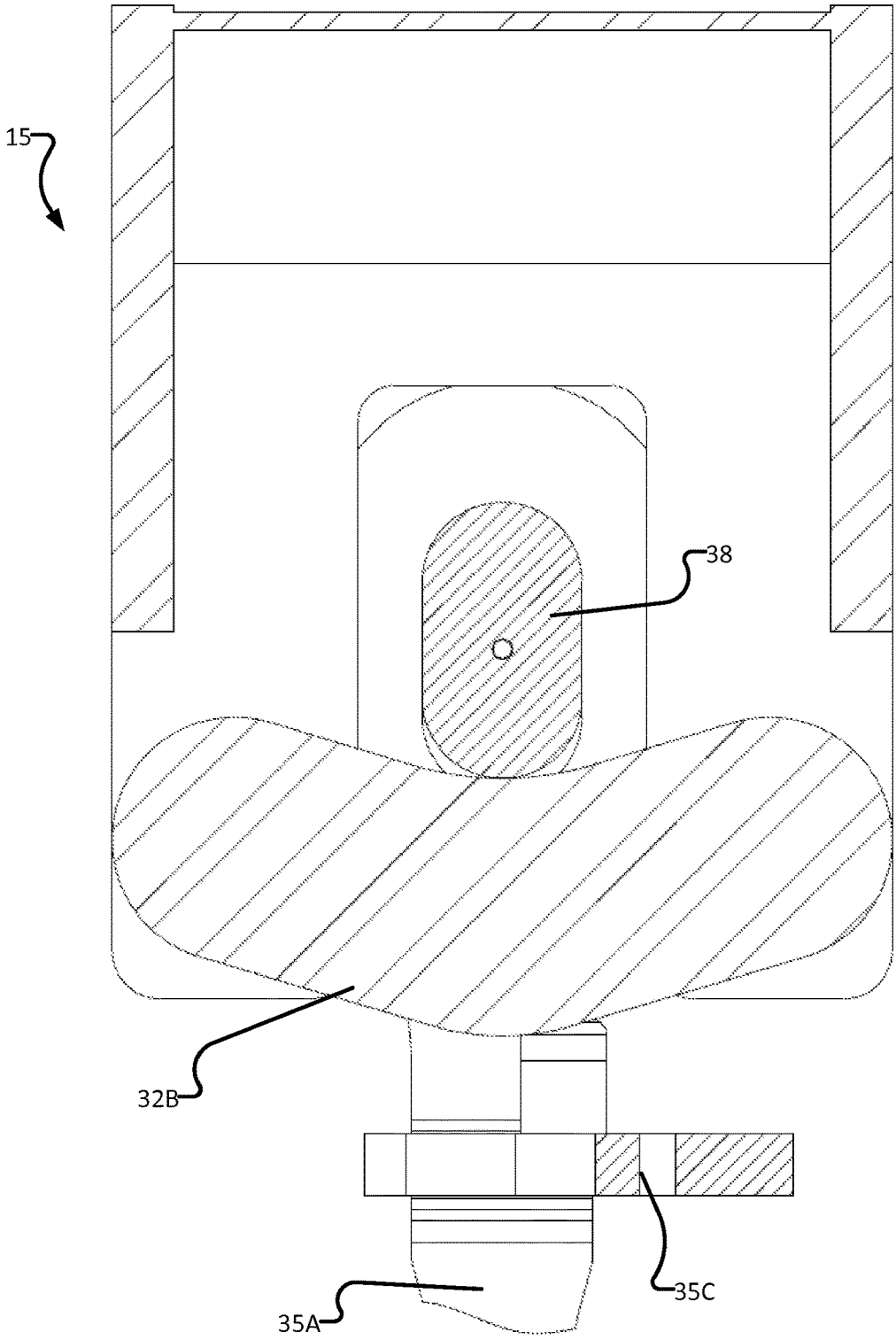
FIG. 3B is a cross section view of the coupling of FIG. 3 in a plane transverse to the views of FIGS. 3 and 3A.

FIGS. 3, 3A and 3B show a coupling 30 according to an example embodiment. Coupling 30 may be used to make a coupling for overhead lifting. For example, coupling 30 may be applied to couple a top drive to a traveling block or other overhead lifting equipment in a drill rig. Coupling 30 may also be used to couple together other elements in heavy lifting or pulling applications. In use, coupling 30 may couple one element to a coupling member attached to another element. The coupling member may, for example, comprise a becket, bail, loop, lug, clevis, eye, or a beam of another coupling 30.

FIGS. 3, 3A and 3B demonstrate the use of coupling 30 to couple a traveling block 32 to a top drive 33 according to a non-limiting example embodiment. Top drive 33 is illustrated by a block since details of construction of the top drive are not relevant to the present invention.

Traveling block 32 may be a legacy-style traveling block with a main body 32A supporting a becket 32B. In the illustrated embodiment, becket 32B is held to traveling block main body 32A by a set of pins. Becket 32B has a saddle-shaped contact area 32D on its upper surface. Contact area 32D has surface curvatures as specified by API standard 8C. Traveling block 32 has a capacity of 250 tons or more in some embodiments.

API Specification 8C (fifth edition) provides that the contact surface of a travelling block becket shall have a convex radius A1 in a plane transverse to the becket and a concave radius B1 in a vertical plane extending longitudinally along the becket as shown in FIG. 8 of API Specification 8C (fifth edition). Table 6 of API Specification 8C (fifth edition) specifies maximum values for A1 and minimum values for B1 as set out in the following Table:

| Load Rating (kN) | Load Rating (Short Tons) | Al max. mm (in.) | B1 min. mm (in.) |
|---|---|---|---|
| 222 to 356 | 25 to 40 | 69.85 (2¾) | 82.55 (3¼) |
| 357 to 578 | 41 to 65 | 69.85 (2¾) | 82.55 (3¼) |
| 579 to 890 | 66 to 100 | 69.85 (2¾) | 82.55 (3¼) |
| 891 to 1334 | 101 to 150 | 69.85 (2¾) | 82.55 (3¼) |
| 1335 to 2224 | 151 to 250 | 101.60 (4) | 82.55 (3¼) |
| 2225 to 3114 | 251 to 350 | 101.60 (4) | 82.55 (3¼) |
| 3115 to 4448 | 351 to 500 | 101.60 (4) | 88.90 (3½) |
| 4449 to 5782 | 501 to 650 | 101.60 (4) | 88.90 (3½) |
| 5783 to 6672 | 651 to 750 | 152.4 (6) | 88.90 (3½) |
| 6673 to 11,120 | 751 to 1250 | 152.4 (6) | 158.75 (6¼) |

Figure 3C:
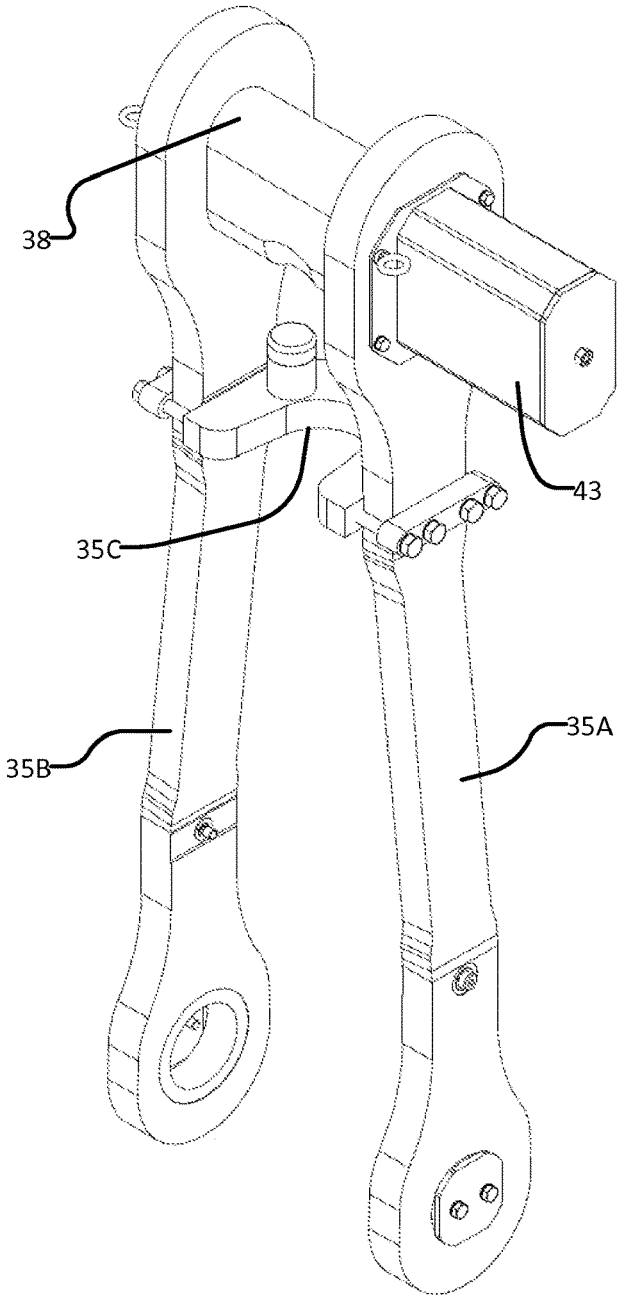
FIG. 3C is a perspective view showing a sliding beam and links of the coupling of FIG. 3.
Figure 3D:
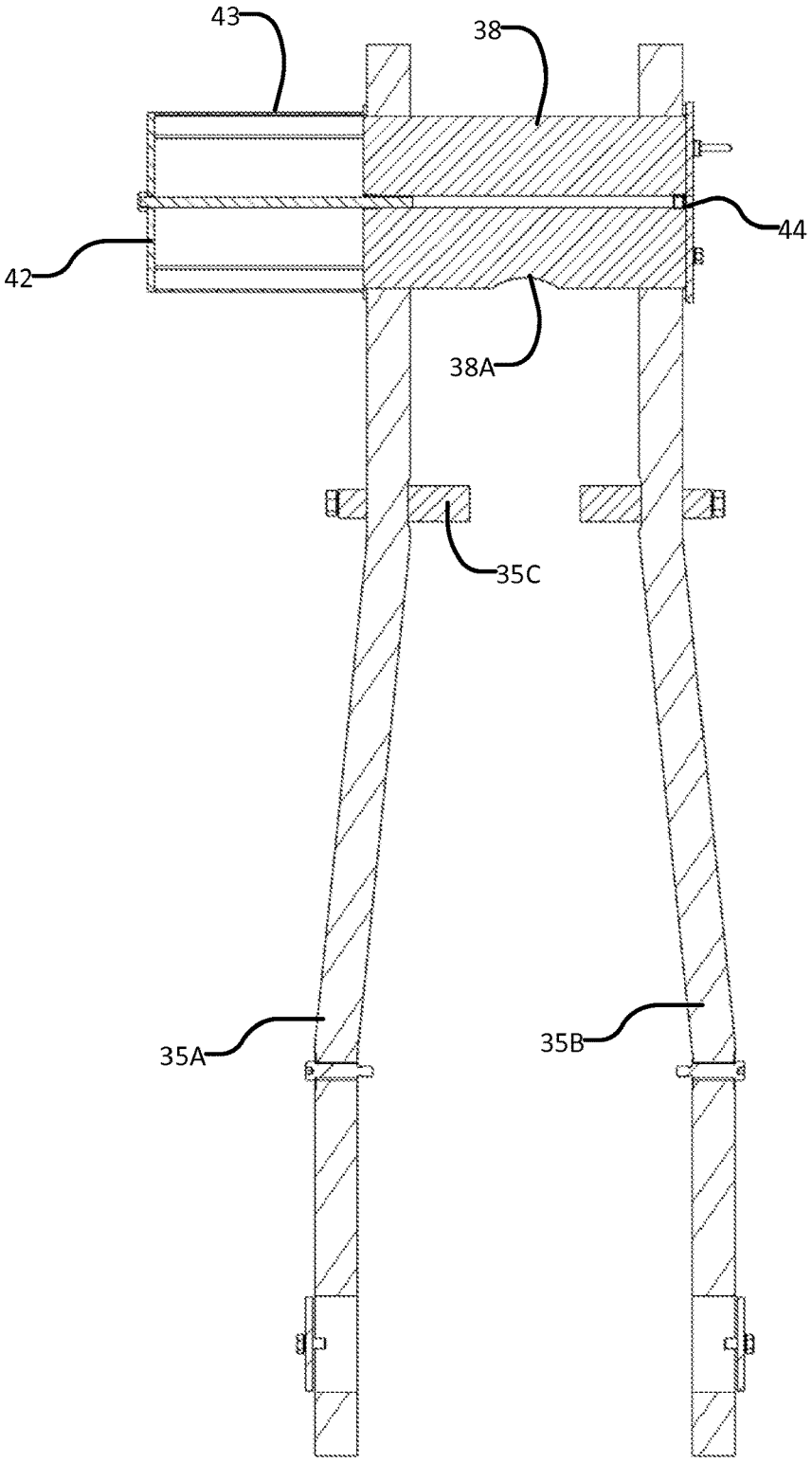
FIG. 3D is a cross-sectional view of the sliding beam and links of FIG. 3C.
Figure 3E:
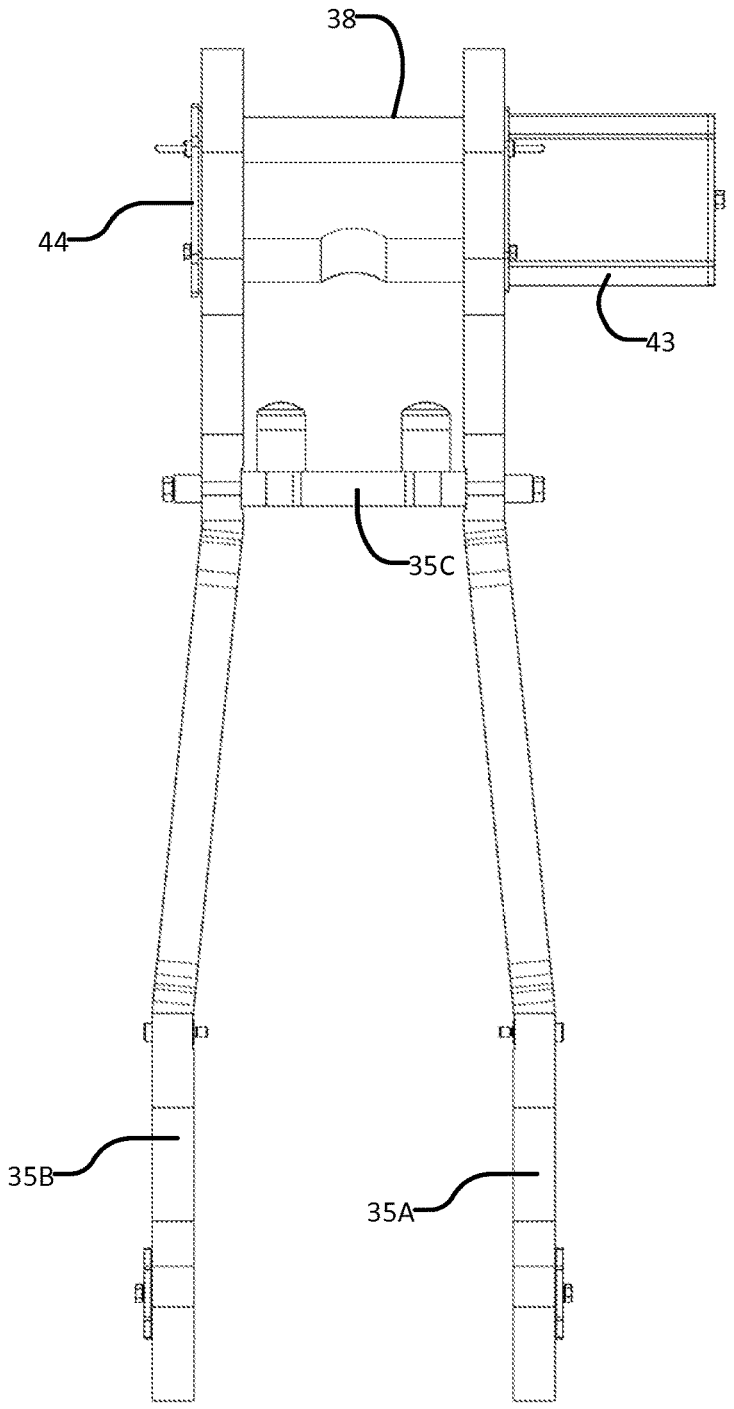
FIG. 3E is a front elevation view of the sliding beam and links of FIG. 3C.

Coupling 30 includes spaced-apart links 35A and 35B that project upwardly from top drive 33 on either side of becket 32B. A space 36 between links 35A and 35B is wide enough to receive becket 32B. Lower ends of links 35A and 35B are coupled to top drive 33 in any suitable manner. In one example embodiment alignment of upper ends of links 35A and 35B is maintained by a bridge 35C attached to each of links 35A and 35B (see FIGS. 3C, 3D and 3E).

Link 35A supports a movable beam 38 that can be actuated as described below to move between a first, retracted, configuration wherein beam 38 is retracted so that becket 32B can pass into space 36 and a second, closed, configuration wherein beam 38 spans between links 35A and 35B. With beam 38 in its first, retracted, configuration, becket 32A can be moved into space 36. When becket 32A is below the path taken by beam 38 in moving from its retracted configuration to its closed configuration, beam 38 may be actuated to move to its closed configuration, thereby making the coupling between traveling block 32 and top drive 33.

Figure 3F:
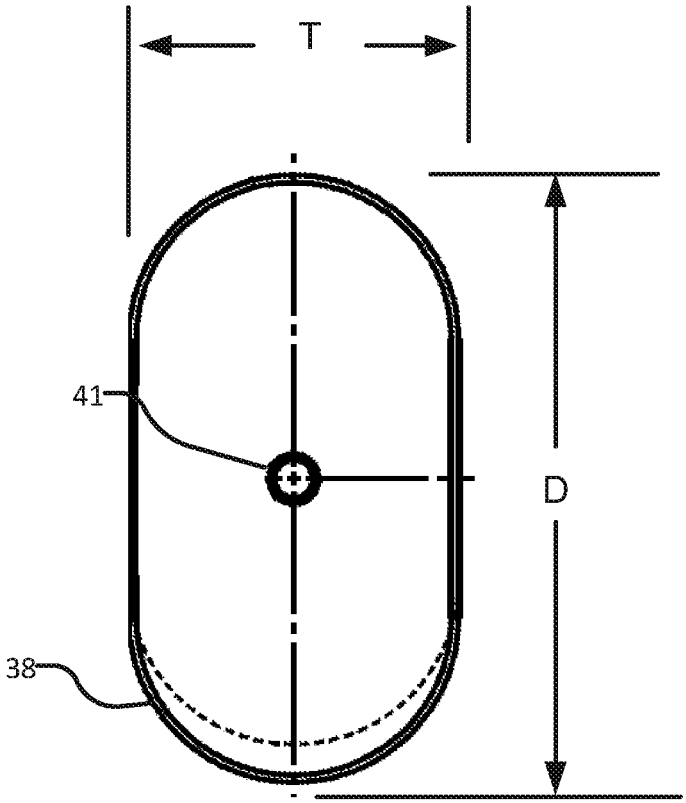
FIGS. 3F and 3G are respectively an end view and side elevation view of the sliding beam from the coupling of FIG. 3.
Figure 3G:
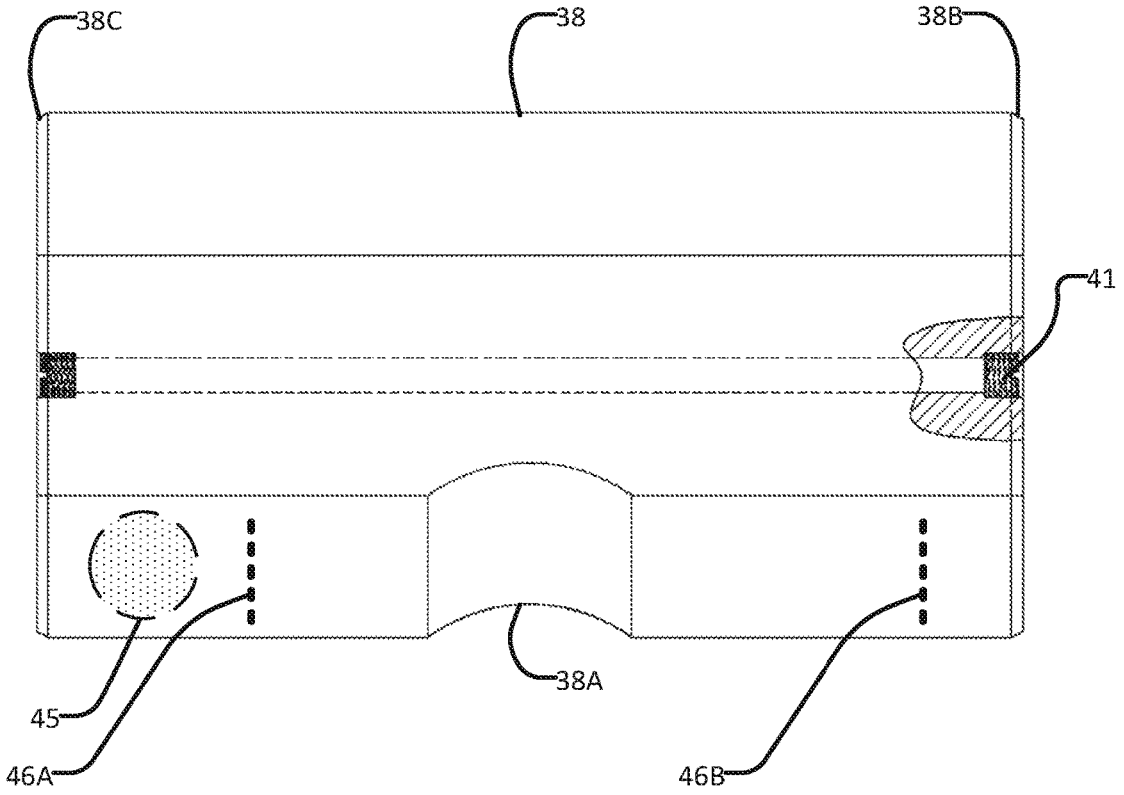

In the illustrated embodiment, beam 38 is non-circular in cross-section and has a depth D greater than its thickness T (See FIGS. 3F and 3G). In some embodiments the ratio of D:T is at least 1.5:1. In some embodiments the ration D:T is in the range of 1.75:1 to 3.25:1. In the illustrated embodiment, beam 38 has an obround cross-section. The cross-sectional shape of beam 38 may, for example, be rectangular (with or without rounded corners), oval, elliptical etc. Making beam 38 in a non-round cross-section with a depth of beam 38 greater than a thickness of beam 38 permits beam 38 to have a required level of strength and yet fit over a becket in a legacy traveling block.

The lower edge of beam 38 has a contact area 38A. Contact area 38A has a compound curvature. When coupling 30 is coupled, beam 38 extends generally at right angles to becket 32B and contact area 38A of beam 38 interfaces to contact area 32D of becket 32B. In the illustrated embodiment beam 38 has a cross-section that is uniform along the length of beam 38 except at the location of contact area 38A. In the illustrated embodiment, the profile of contact area 38A of beam 38 lies within the cross-section (i.e. contact area 38A does not project from beam 38).

The material of beam 38 preferably satisfies the requirements of API Specification 8C. In an example embodiment, the material of beam 38 has a yield strength exceeding 110 kpsi. For example, beam 38 may be made of a steel alloy having a yield strength of 120 kpsi or more. In some embodiments beam 38 has an impact toughness of 31 ft-lb (42 J) at −40° F. (−40° C.) average using test specimen with no individual value less than 24 ft-lb (32 J). In some embodiments the material of beam 38 has all of these properties. In an example embodiment, beam 38 is made from AISI 4430 quenched and tempered steel. Beam 38 may be coated, for example with a nitride layer (indicated schematically by 45, see FIG. 3G), to provide protection against corrosion. In some embodiments the coating is not extended to contact area 38A.

Beam 38 is supported against rotation relative to links 35A and 35B. In the illustrated embodiment, beam 38 extends through an aperture 39A in link 35A. Aperture 39A has a cross-sectional shape that partially or entirely conforms to the cross-sectional profile of beam 38 such that beam 38 can slide longitudinally back and forth through aperture 39A but cannot rotate significantly about its longitudinal axis in aperture 39A. In the illustrated embodiment, link 35B has an aperture or recess 39B that is aligned with aperture 39A such that, in its second, closed configuration, a first end 38B of beam 38 projects into aperture or recess 39B. In the illustrated embodiment, aperture 39B has a cross-sectional shape that partially or entirely conforms to the cross-sectional profile of beam 38 such that end 38B of beam 38 can slide longitudinally into aperture 39B but cannot rotate about its longitudinal axis in aperture 39B.

In a simple embodiment, beam 38 is manually-actuated between its retracted and closed configurations. Beam 38 may have a coupling (e.g. a hook, eye, threaded aperture, threaded stud, etc.) on one or both of its first end 38B and its second end 38C to allow attachment of a tool for pushing beam 38 toward its closed configuration or pulling beam 38 toward its retracted configuration.

Preferably a force-amplifying drive mechanism is provided. For example, the illustrated embodiment includes a drive screw 40 that can be threaded into threaded openings 41 at either end of beam 38. To draw beam 38 toward its retracted configuration screw 40 may be inserted through a hole in a plate 42 spaced outwardly from link 35A and then threadedly engaged with second end 38C of beam 38. FIG. 3 shows this configuration. Tightening screw 40 pulls beam 38 toward plate 42. In the illustrated embodiment, drive screw 40 has a head 40A which allows drive screw 40 to be turned using a wrench (which could be a hand wrench, a pneumatic driver, or the like).

In the illustrated embodiment, plate 42 forms one end of a housing 43 that is attached to link 35A and covers aperture 39A. When beam 38 is in its retracted configuration, second end 38C of beam 38 is received in housing 43. Housing 43 may comprise guide surfaces that bear against beam 38 and thereby help to maintain beam 38 in alignment with apertures 39A and 39B. Housing 43 may protect the projecting part of beam 38 from damage and may help to hold beam 38 in position during transportation. Screw 40 may be left in place to hold beam 38 in its retracted configuration during transportation. This is the configuration shown in FIG. 3A.

Housing 43 may have a wide range of configurations. Housing 43 may have openings on its sides or be closed. Housing 43 may comprise an open framework, for example. In some applications housing 43, as illustrated, may be in the way and undesirable. For such applications housing 43 may be made removable and/or foldable/collapsible.

To move beam 38 toward its closed configuration, screw 40 may be inserted through a hole in a plate 44 on link 35B and threadedly engaged with first end 38B of beam 38. Tightening screw 40 pulls beam 38 toward plate 44. Screw 40 may be tightened and left in place to hold beam 32 firmly in its closed configuration.

An advantage of the illustrated arrangement is that the pull exerted by screw 40 on beam 38 as beam 38 is moved toward its closed configuration tends to pull beam 38 into alignment with aperture 39B.

In an alternative embodiment a first end 40A of drive-screw 40 is fixed in position but free to rotate relative to link 35A. For example, drive screw 40 may be mounted in an aperture in plate 42. In this embodiment, a second end 40B of drive screw 40 is threadedly engaged with end 38C of beam 38. Beam 38 may be advanced toward its closed configuration by rotating drive screw 40 in a first direction and moved toward its retracted configuration by rotating drive screw 40 in a second direction opposite to the first direction.

In some embodiments, a motor (e.g. a hydraulic motor) is provided and connected to turn drive screw 40. In some embodiments the motor comprises an impact driver. The motor may be directly coupled to drive screw 40 or coupled by way of a suitable power transmission such as a gear train, worm drive, reducing transmission, or the like.

Other actuation mechanisms may be applied for moving beam 38 between its closed and retracted configurations. Examples of such actuation mechanisms which may be coupled to drive motion of beam 38 include:

- one or more linear actuators (which may be any of hydraulic, pneumatic or electrically operated);
- a rack and pinion mechanism;
- a rack and worm mechanism;
- one or more hydraulic pistons;
- a lever;
- a removable screw, cable or the like may be connected to pull beam 38 from its retracted configuration to its closed configuration.

In some embodiments which provide for powered actuation of beam 38 an actuator such as a motor/hydraulic piston of the like is built into a hollow within beam 38.

When an integrated power actuation mechanism is provided, a remote control mechanism may optionally be provided to operate the actuation mechanism to move beam 38 from its retracted configuration to its closed configuration or from its closed configuration to its retracted configuration. The remote control mechanism may comprise, for example, a remotely operable electrical, pneumatic or hydraulic circuit.

In embodiments which provide means for remotely actuating beam 38 it is preferable to provide one or more mechanisms that may be provided to verify that beam 38 has properly reached its closed position. For example, one or more of the following may be supplied:

- a camera located to provide remote viewing of beam 38 and connected to display an image on a display;
- one or more limit switches and/or proximity sensors located to detect when beam 38 is in its closed configuration;
- a linear transducer connected to monitor the position of beam 38;
- visible indicia such as a colored stripe or mark (indicated schematically by 46A—see FIG. 3G) on beam 38 that becomes visible only when beam 38 is in its closed configuration;
- a marking (indicated schematically by 46B—see FIG. 3G) that is visible only when the beam is not in the closed configuration.

Figure 4A:
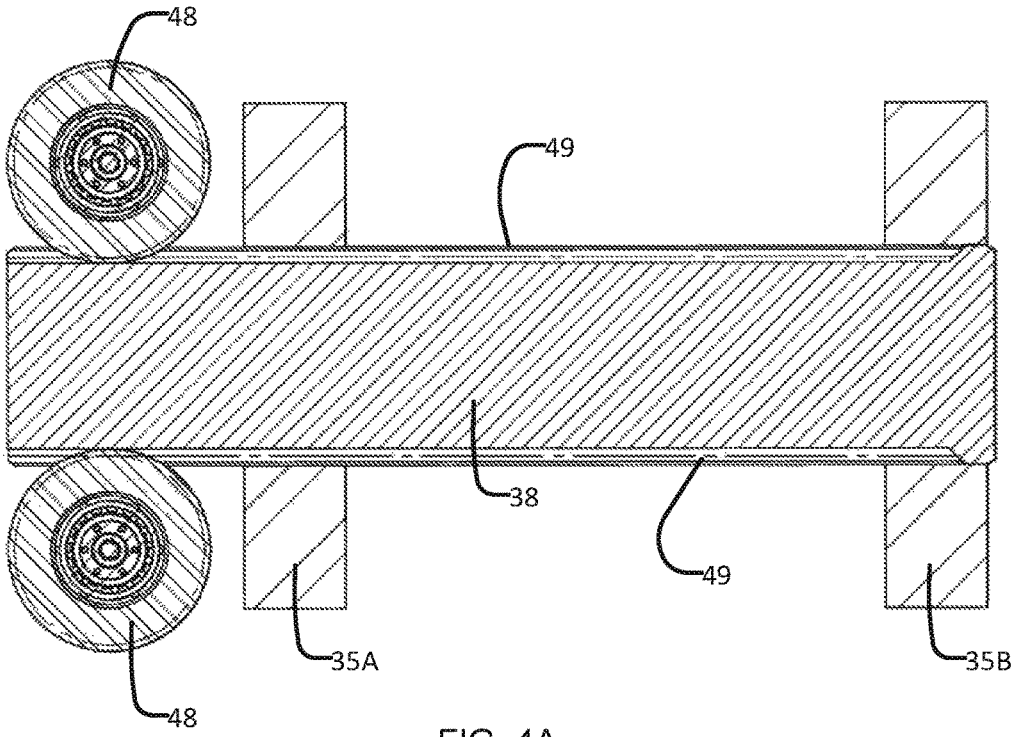
FIG. 4A is a cross sectional view thereof.
Figure 4:
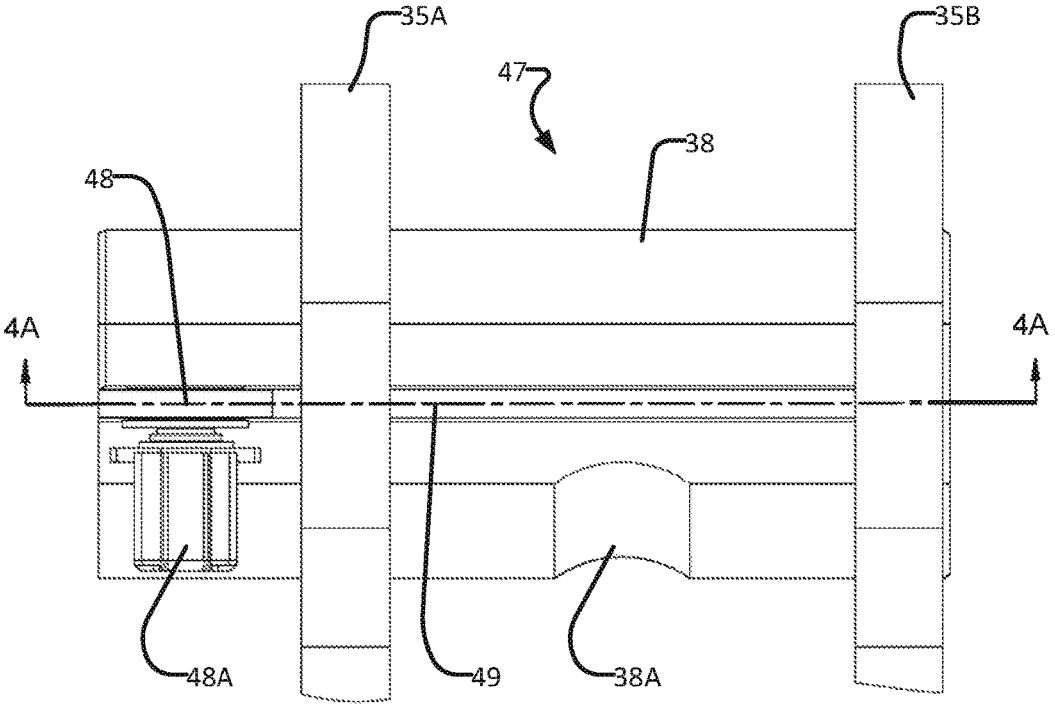
FIG. 4 is a schematic side elevation view showing a coupling according to an alternative embodiment comprising a sliding beam actuated by a rack and pinion mechanism.

FIG. 4 shows a coupling 47 according to an alternative embodiment. Coupling 47 is similar to coupling 30 and similar parts are given the same reference numbers. Coupling 47 differs from coupling 30 in that beam 38 is actuated by a pinion 48 which engages a rack 49 attached to or formed in beam 38. Pinion 48 may be turned manually using a handle or wrench (not shown) or under power using a motor of any suitable type coupled to drive pinion 42 in any suitable way. Motor 48A is shown. Motor 48A may incorporate a reduction drive. In the illustrated embodiment beam 38 has racks 49 extending along both of its sides. Preferably racks 49 extend along the neutral axis of beam 38. Each of the racks is driven by a corresponding pinion 48. In this manner, radial gear forces exerted by one pinion 48 on beam 38 are balanced by the radial gear forces exerted by the other pinion 48 on beam 38.

Figure 5:
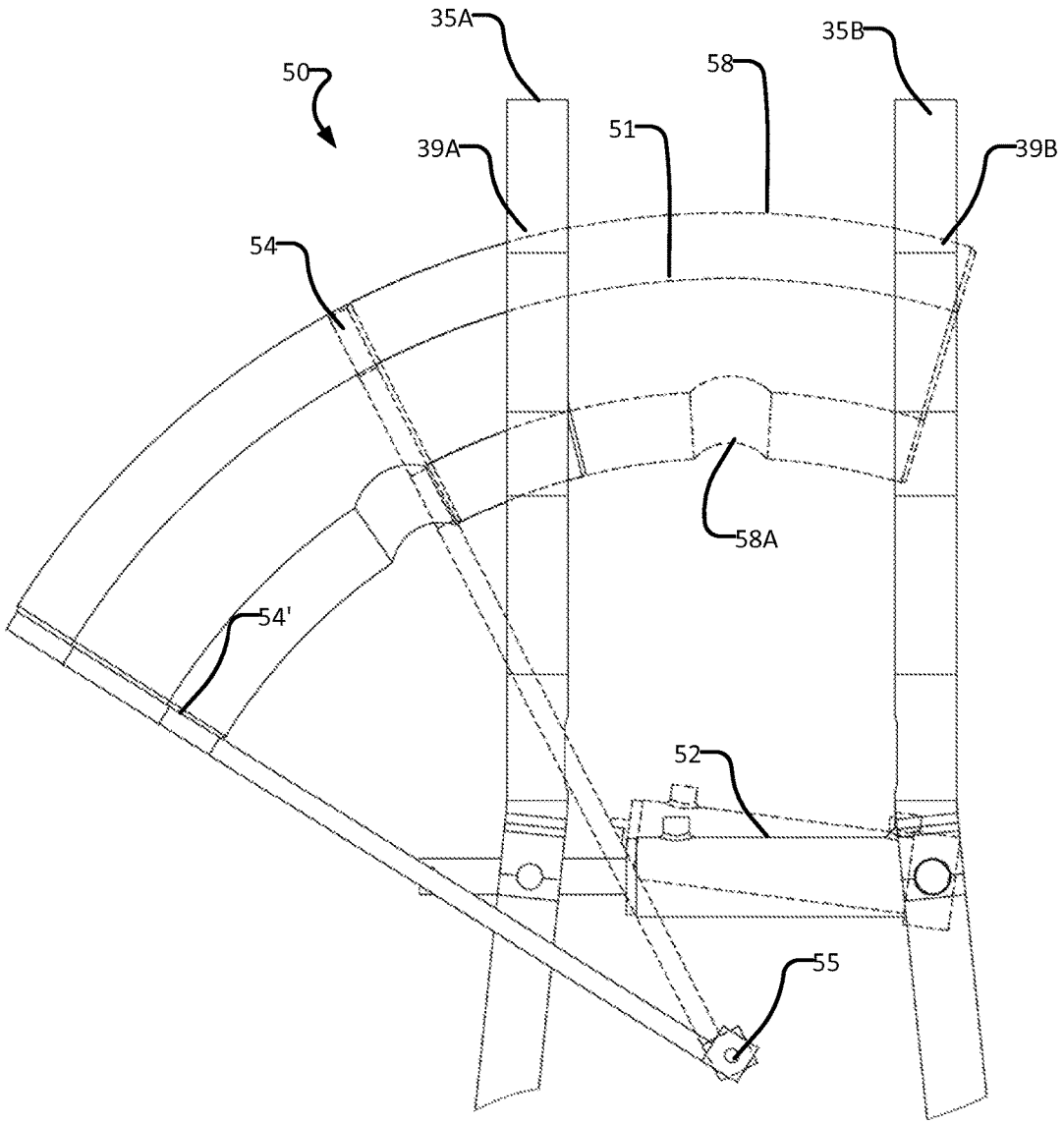
FIG. 5 is a schematic sketch showing the principle of operation of an alternative embodiment having an arcuate beam movable in an arcuate path.

FIG. 5 shows a coupling 50 according to an alternative embodiment. Coupling 50 is similar to coupling 30 and similar parts are given the same reference numbers. Coupling 50 differs from coupling 30 in that beam 38 is replaced in coupling 50 by an arcuate beam 58. When beam 58 is actuated it moves along a curved path 51. Aperture 39A and aperture or recess 39B are respectively configured to constrain beam 58 to be movable along path 51 and to receive beam 58 as it is moved to its closed configuration along path 51. In the illustrated embodiment, beam 58 is actuated by a hydraulic cylinder (or other linear actuator) 52 coupled to pivot an arm 54 about a pivot point 55. Beam 58 is shown in its closed configuration. Dotted outline 54' shows the location of arm 54 when beam 58 is in its retracted configuration.

Some advantages of the illustrated example embodiments are that:

- they are compatible with API standards for curvatures and strength and can be used to couple top drives to legacy traveling blocks;
- angular flexibility between the top drive and travelling block can be equal to that provided by a traditional becket/bail connection;
- they can be used without disconnecting a becket from a traveling block;
- little to no tooling is required to translate beam 38/58 to engage with or disengage from a becket;
- operating beam 38 does not require working with heavy loose parts at elevated locations;
- alignment of beam 38/58 with aperture or recess 39B is maintained by the structure of coupling 30. Workers do not need to achieve precise alignment of heavy parts (as would be required, for example, to reinstall a pin holding a becket to a traveling block);
- human lifting and pushing is reduced or eliminated;
- coupling 30 may be connected without moving the traveling block laterally (as can be required to slide the becket of a traveling block under a conventional bail on a top drive). The traveling block does not generally need to be moved away from the vertical (Z-axis) during connection.

While these advantages are beneficial, it is not mandatory that all of these advantages be provided by all embodiments.

It is not mandatory that the part of a coupling like coupling 30, 47 or 50 that includes a movable beam is on a top drive. In some embodiments a traveling block or traveling block adapter includes a movable beam in place of a conventional becket.

Figure 6:
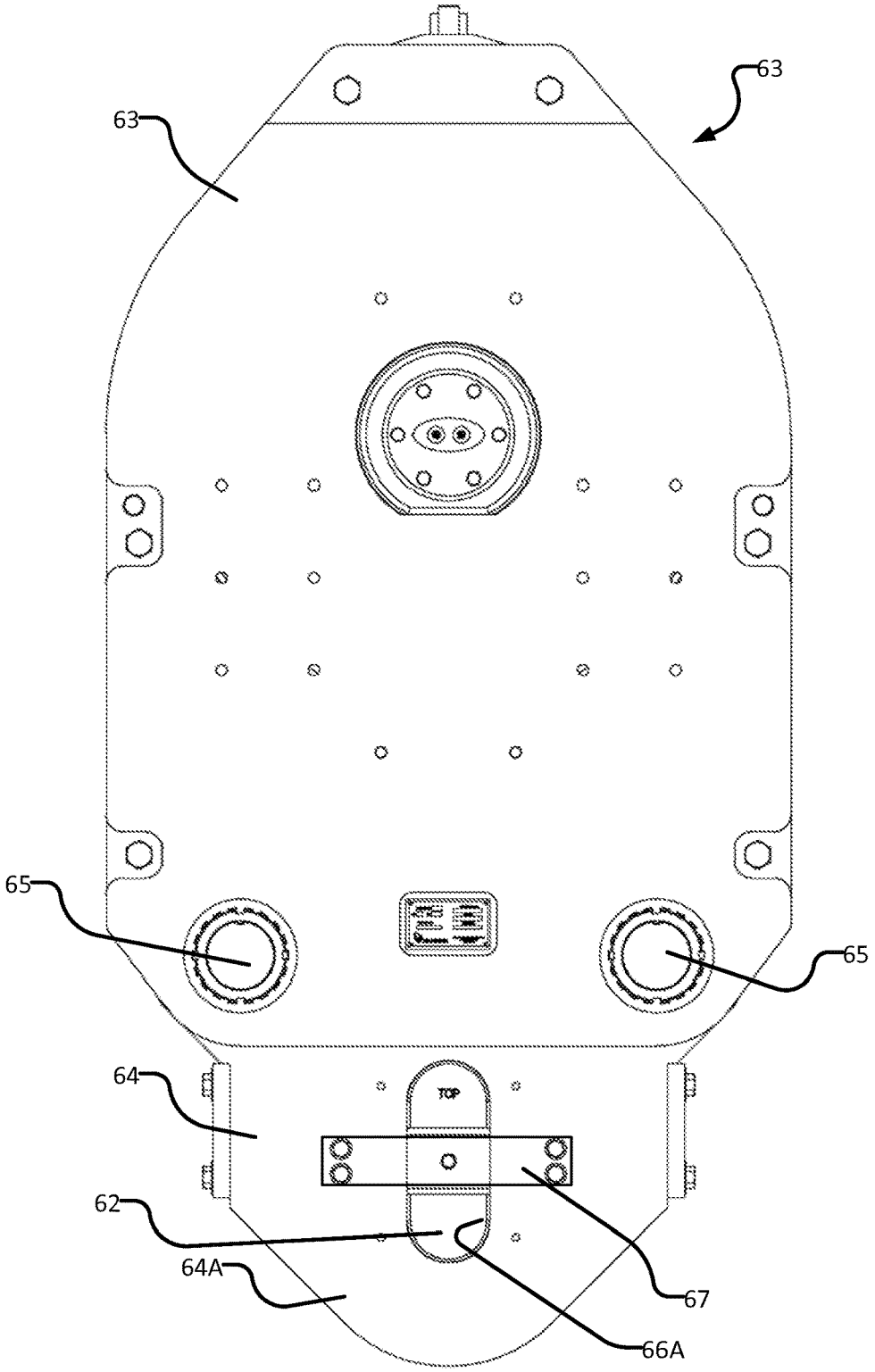
FIG. 6 is a front elevation showing a traveling block equipped with a transversely movable becket beam.
Figure 6A:
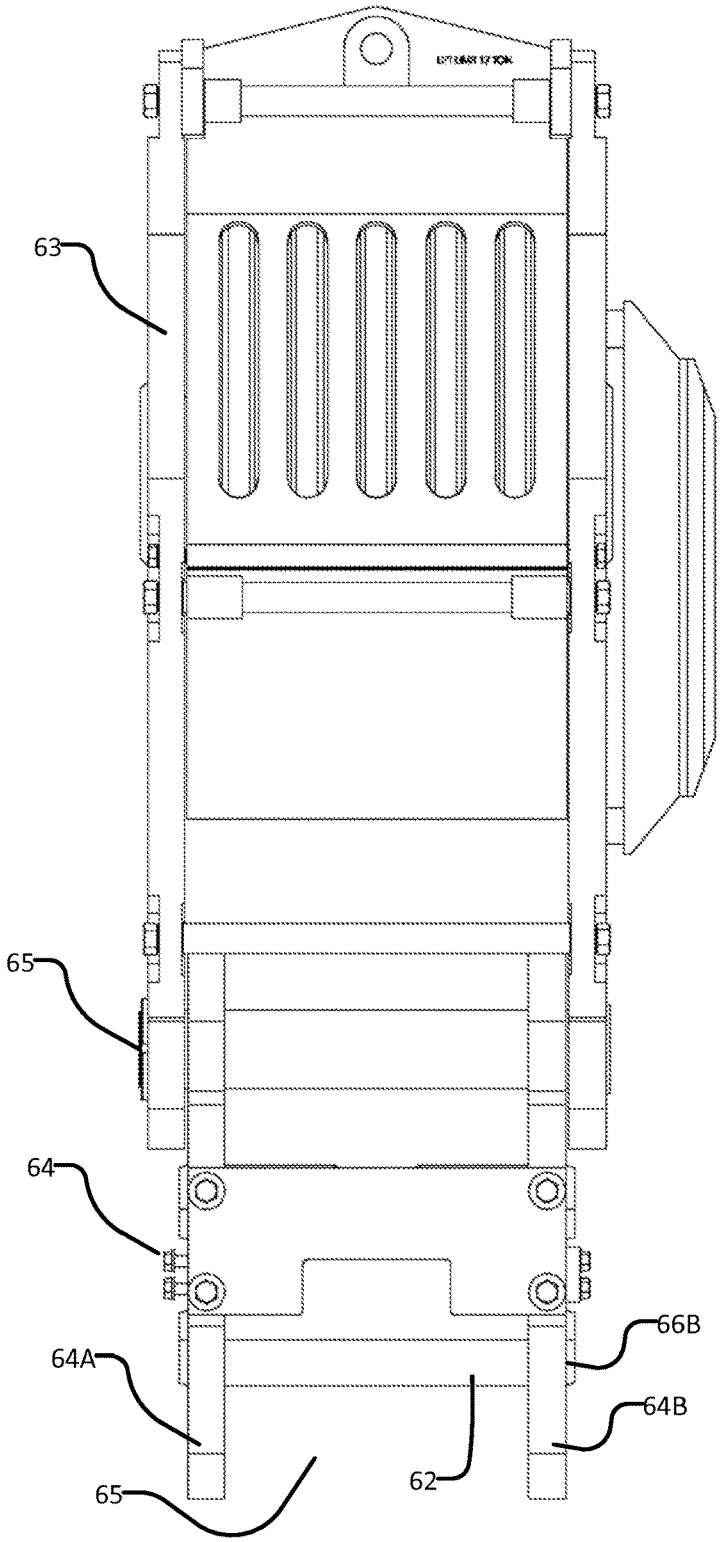
FIG. 6A is a side elevation view of the traveling block of FIG. 6.
Figure 6B:
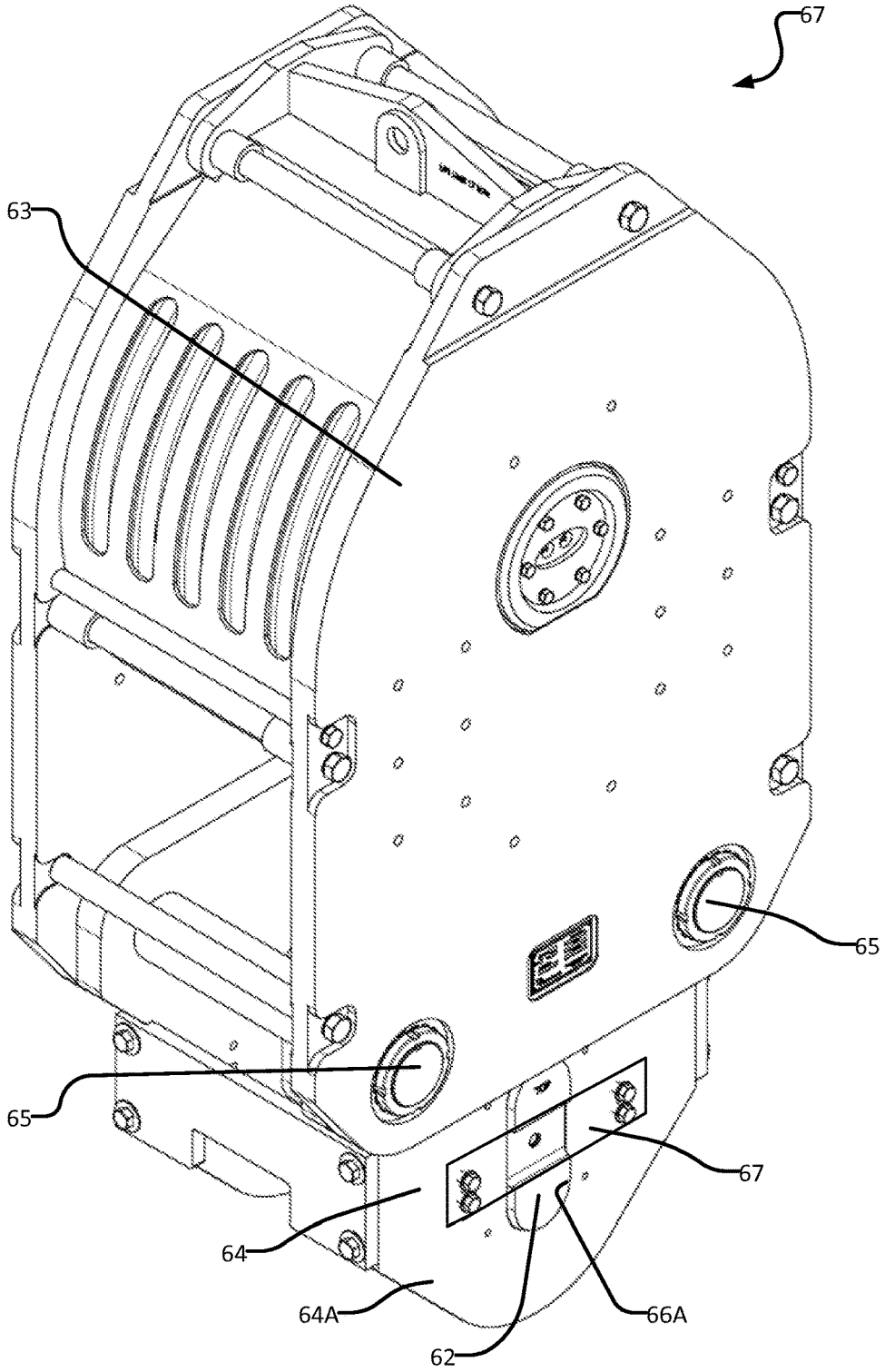
FIG. 6B is a perspective view of the traveling block of FIG. 6.

FIGS. 6 to 6B show an example traveling block 60 comprising a movable beam 62. Traveling block 60 comprises a main body 63. A coupling assembly 64 is pinned onto main body 63 by pins 65. Coupling assembly 64 comprises plates 64A and 64B. Movable beam 62 passes through an aperture 66A in plate 64A and spans a space 65 between plates 64A and 64B to engage an aperture or recess 66B in plate 64B.

Beam 62 may be substantially the same as beam 38 described above except that it is oriented to provide a saddle-shaped contact area on its upper edge (i.e. the edge facing toward main body 63). As described above with respect to FIG. 3, aperture 66A maintains beam 62 aligned with aperture or recess 66B and apertures 66A and 66B are configured to prevent rotation of beam 62.

In the illustrated embodiment, beam 62 is retained in its closed configuration by a keeper 67 which extends across aperture 66A to block longitudinal movement of beam 62. When it is desired to move beam 62 to its retracted position, keeper 67 may be moved out of the way (e.g. by detaching it from plate 64A, unfastening one end of keeper 67 and pivoting keeper 67 out of the way, etc.).

Figure 6C:
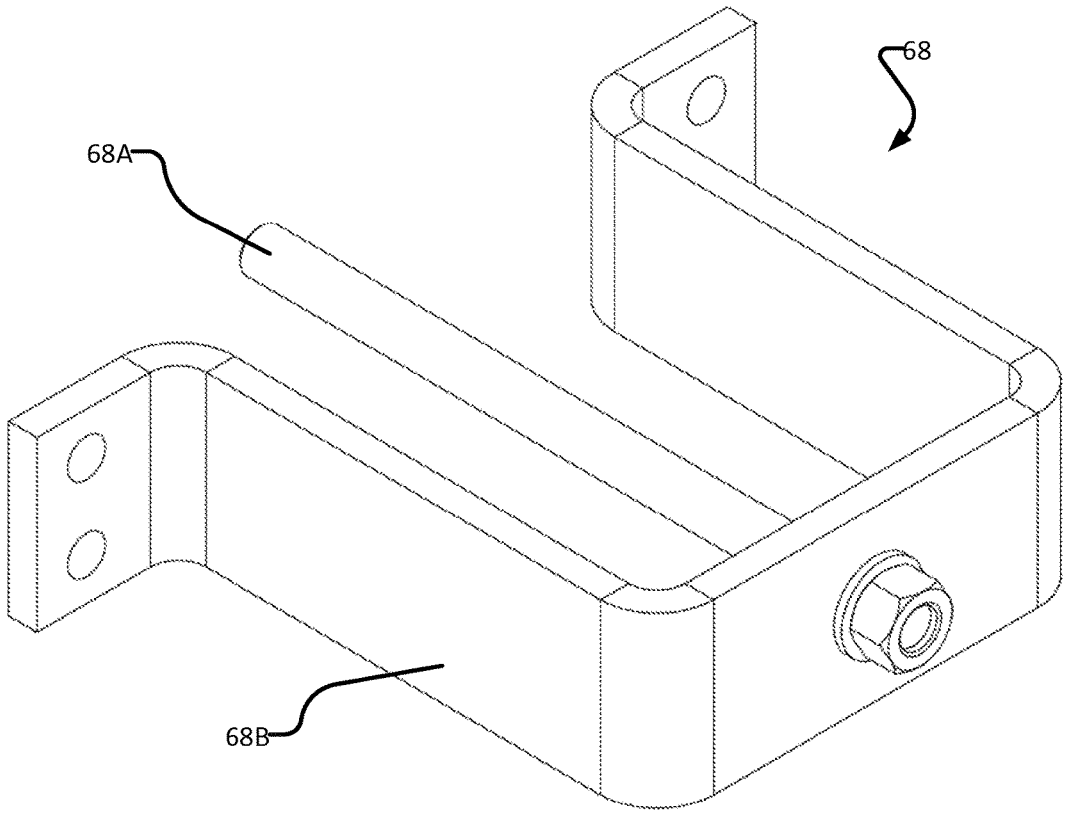
FIG. 6C is a perspective view of a tool for use in moving the transversely-movable becket beam of the traveling block of FIG. 6.

A removal tool 68 is shown in FIG. 6C. Removal tool 68 comprises a screw 68A that is rotatably mounted to a frame 68B. When it is desired to move beam 62 to its retracted configuration, keeper 67 may be removed and screw 68A may be started into a threaded bore in beam 62. Frame 68B may then be removably attached to plate 64A (e.g. by bolting frame 68B into threaded holes which may be the same threaded holes used to hold keeper 67). After this has been done, beam 62 may be pulled to its retracted position by turning screw 68A using any suitable tool. The process may be reversed to move beam 62 back to its closed configuration.

In cases where removal tool 68 would not pose an inconvenient obstruction, removal tool 68 may be left installed on plate 64.

In other embodiments, any of the actuation mechanisms described above are provided to actuate beam 62 between its retracted and closed configurations.

Figure 7:
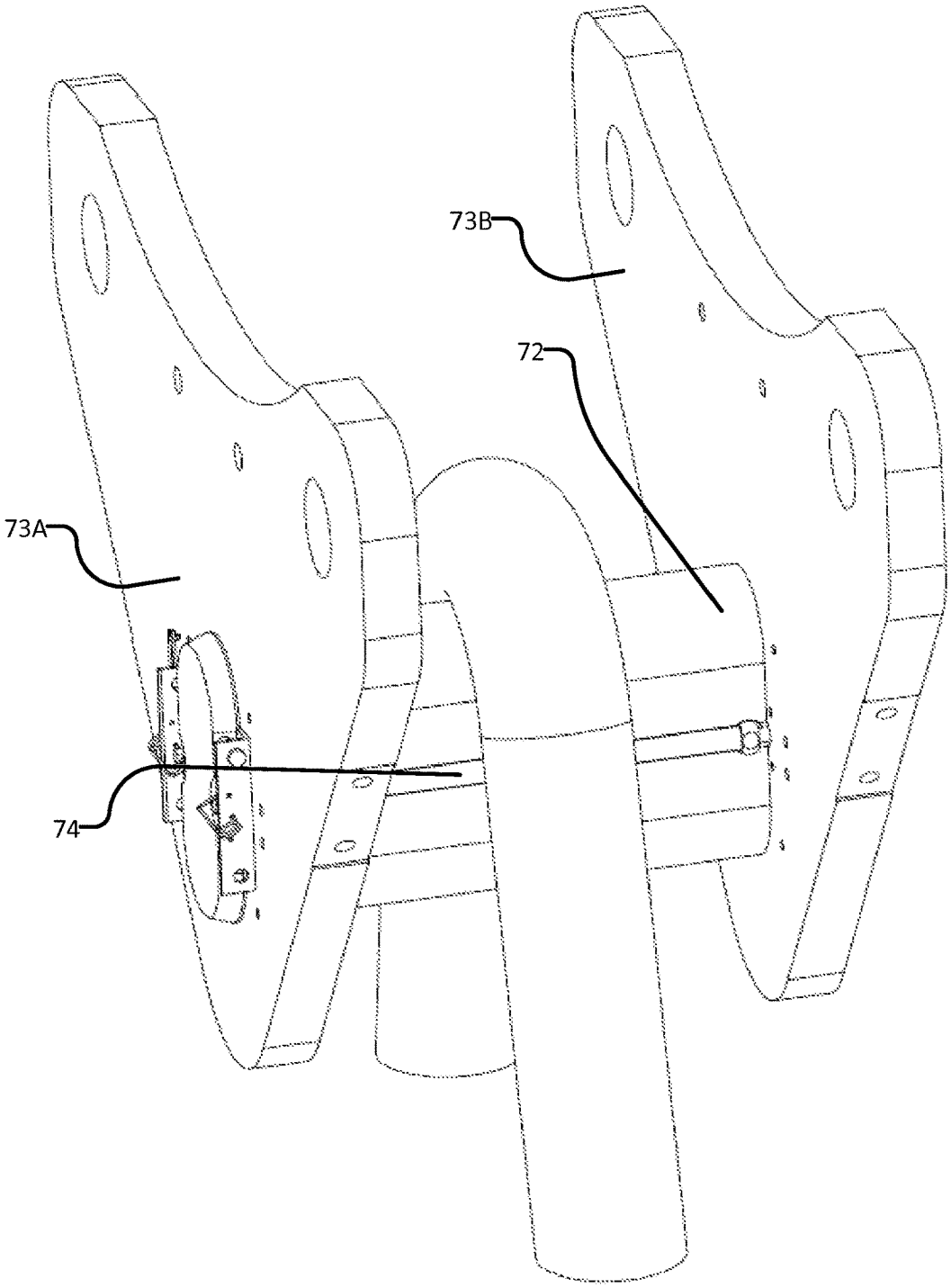
FIG. 7 is a front elevation showing an alternative mechanism for actuating a transversely-movable becket beam.
Figure 7A:
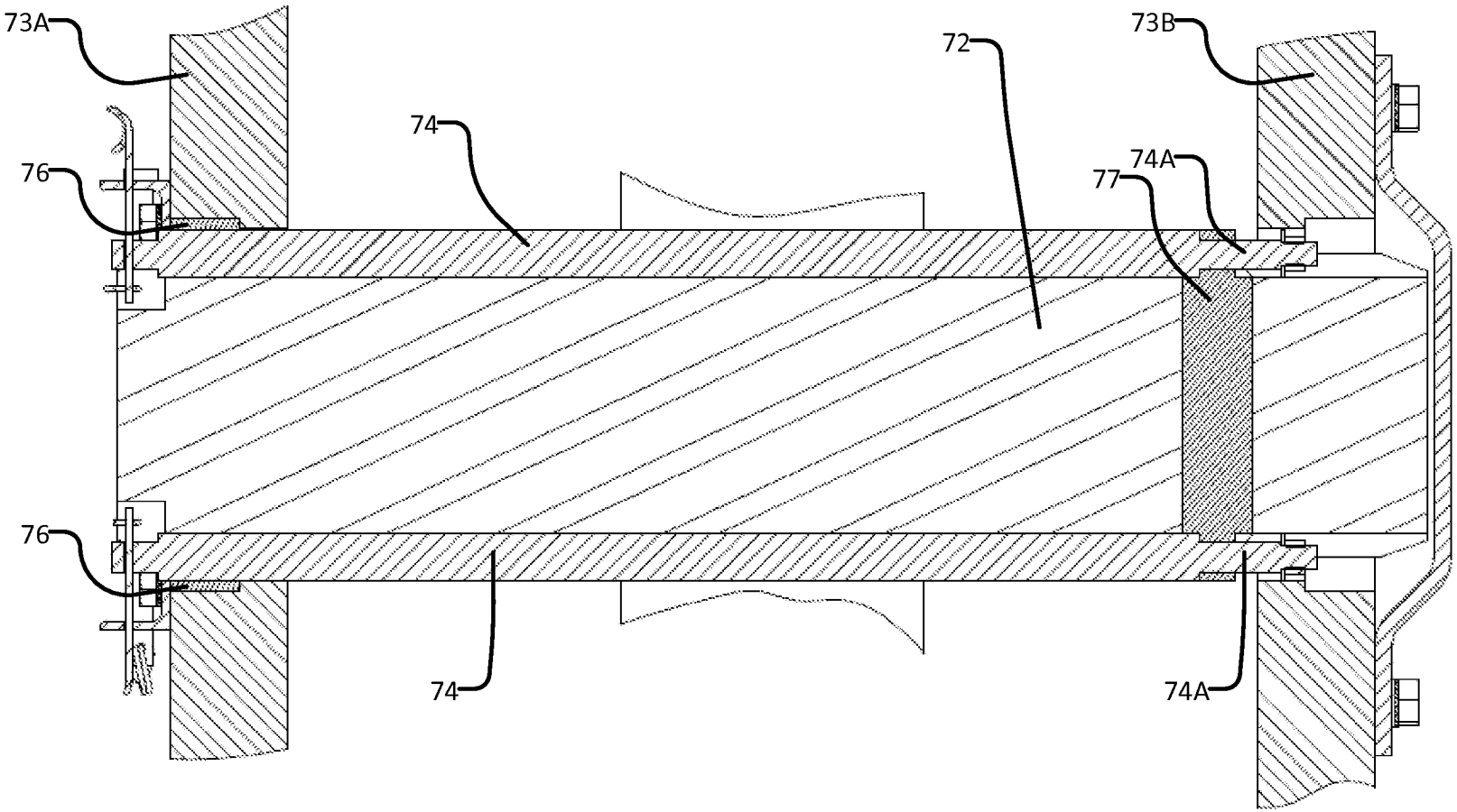
FIG. 7A is a side elevation view of the mechanism of FIG. 7.
Figure 7B:
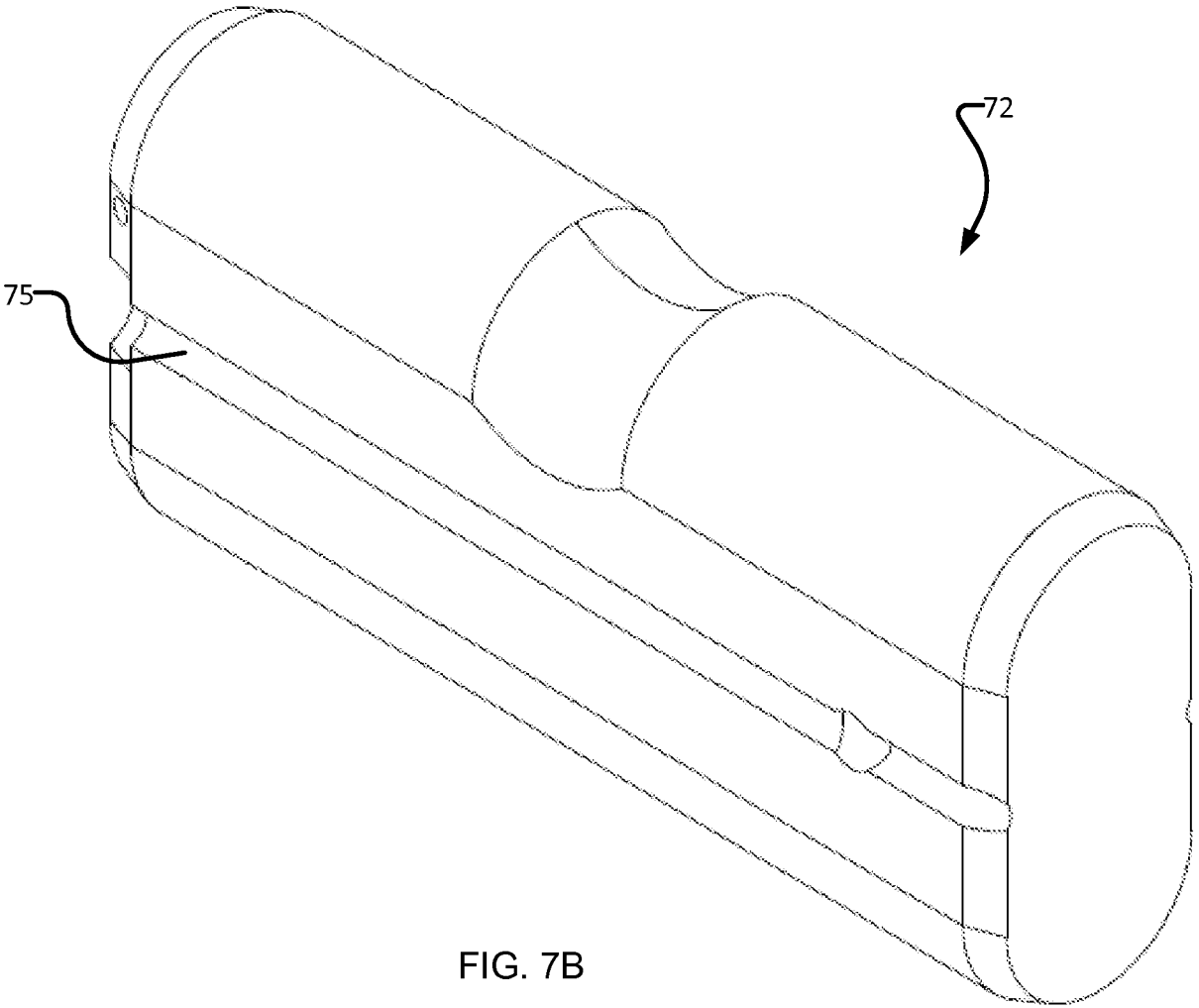
FIG. 7B is a side elevation view of the becket beam of FIG. 7.
Figure 7C:
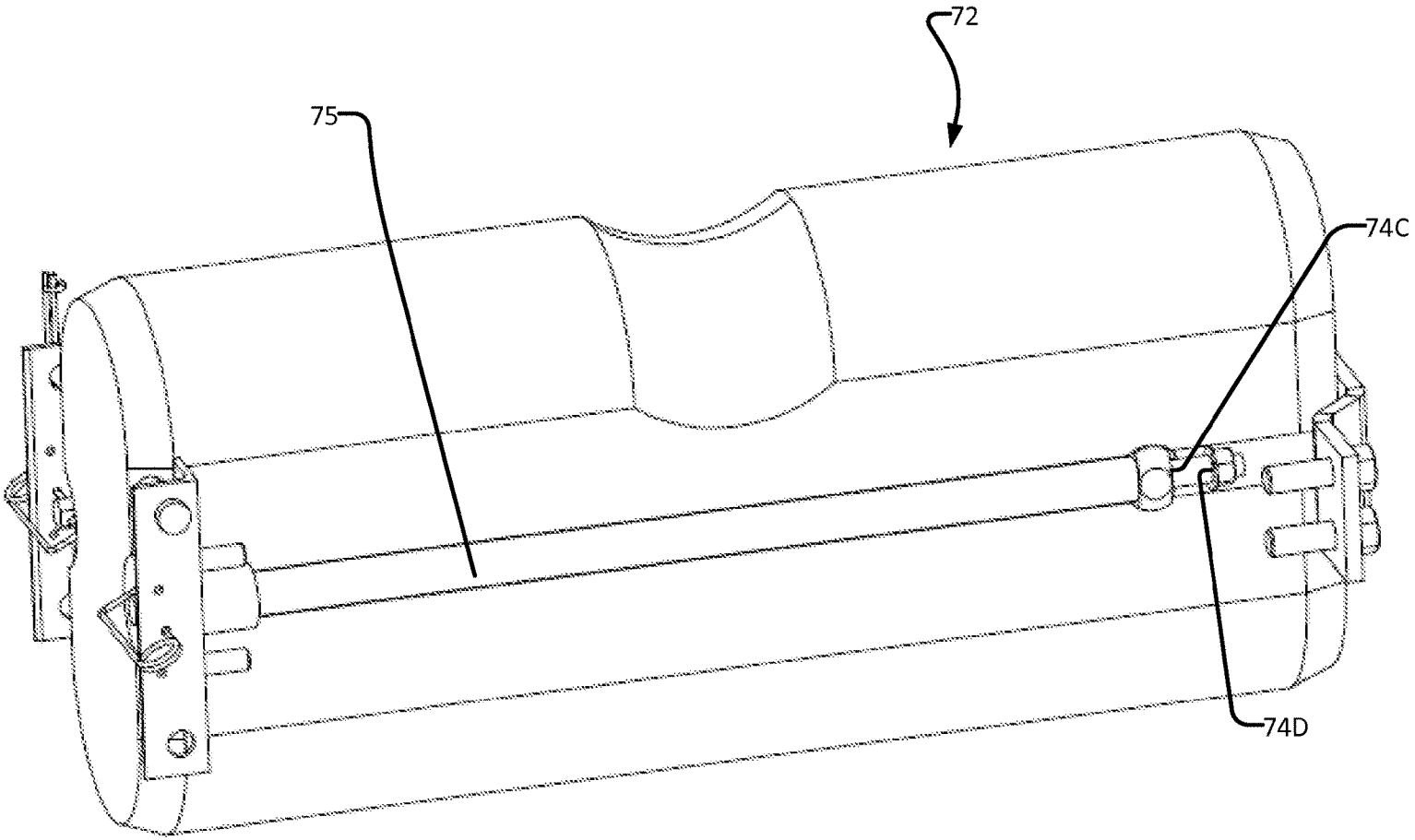
FIG. 7C is a side elevation view of the becket beam and part of the mechanism for actuating the transversely-movable becket beam of FIG. 7.

FIGS. 7 to 7C illustrate apparatus 70 comprising a further alternative example mechanism for actuating a sliding becket beam 72 to close or open a gap between members 73A and 73B. In the illustrated embodiment, screws 74 are rotatably mounted on either side of becket beam 72. Screws 74 may extend along a neutral axis of becket beam 72 in some embodiments. In the illustrated embodiment, each screw 74 is partially disposed in a longitudinal groove 75 that extends along a side of becket beam 72.

Member 73A supports thread-engaging features 76 that engage threads on each screw 74. Thread-engaging features 76 each include at least one thread, pin or blade that engages threads on the corresponding screw 74. Advantageously the features that engage threads on screws 74 may engage the threads only on a side of the corresponding screw 74 that faces away from becket beam 72. Thread-engaging features 76 may comprise half-nuts, for example.

Rotating a screw 74 causes the screw 74 to move longitudinally relative to the corresponding thread-engaging feature 76. Screws 74 are coupled to becket beam 72 so that becket beam 72 may be moved relative to member 73A by turning screws 74.

The connections between screws 74 and becket beam 72 may be constructed to allow some longitudinal play. In some embodiments the play may be 1 cm or more. This facilitates advancing becket beam 72 by turning one of screws 74 at a time. In the illustrated embodiment, each screw 74 has a turned-down portion 74A that is slidable in a bore in a lug projecting from becket beam 72. In the illustrated embodiment, screws 74 engage bores in a push/pull support rod 77 carried on becket beam 72. A pair of spaced-apart shoulders 74C and 74D limit the travel of screw 74 relative to becket beam 72 by engaging corresponding surfaces on becket beam 72. Those of skill in the art will recognize that there are many other possible arrangements for mounting screws 74 to becket beam 72 in such a manner that permits rotation of screws 74 and optionally provides some longitudinal play between screws 74 and becket beam 72.

In some embodiments each screw 74 comprises a head or other fitting that allows the screw 74 to be turned by a suitable hand or power tool. For example, ends of screws 74 may comprise hexagonal or other-shaped heads that can be gripped by a wrench or socket or hexagonal, splined or other-shaped recesses that may be rotationally engaged by a suitable wrench or key.

Some embodiments provide for synchronized turning of both screws 74. Such synchronization may be provided by a mechanism incorporated into apparatus 70 or by a tool used to operate screws 74. For example, screws 74 may be coupled by a gear train that causes both screws 74 to rotate in a synchronized fashion. In such a case the gear train may cause both screws 74 to rotate in the same direction (and both screws 74 may be threaded the same—either left-handed or right-handed threads). In the alternative, the gear train may cause screws 74 to rotate in opposite directions and screws 74 may have opposite threads.

As another example, a power or hand tool for operating screws 74 may have separate rotational outputs for coupling to each of screws 74. The rotational outputs may be connected by a gear train, timing belt or other power transmission so that screws 74 are driven in a synchronized manner to advance becket beam 72 smoothly either into a closed position where it extends across a gap between members 73A and 73B or onto a retracted position where the gap between members 73A and 73B is sufficiently unobstructed that a becket may be moved into or out of the gap. In some embodiments becket beam 72 may be completely removed from engagement with members 73A and 73B. The rotational outputs may be spaced apart from one another with a spacing that matches a spacing of screws 74.

An advantage of the apparatus illustrated in FIGS. 7-7D is that when becket beam 72 is in its closed position the mechanism for actuating motion of becket beam 72 does not need to protrude very far or at all outward from the outer face of member 73A.

A retractable beam becket as described herein may be provided on a top drive, on a travelling block, or both. A retractable beam becket as described herein may also be applied on other hoisting equipment (e.g. on a swivel or heave compensator).

Various alternatives are possible. For example:

a coupling as described herein may be made to interface to traveling blocks having capacities of less than 250 tons as well as greater than 250 tons;

a coupling as described herein may provide contact areas having surface curvatures other than those defined by API standard 8C;

a coupling as described herein may be applied to couple together elements other than a traveling block and a top drive;

a beam in a coupling as described herein may be held against rotation by other means instead of or in addition to providing apertures shaped to conform with a cross-sectional profile of the beam. For example, one or more suitable bolts, pins, clamps, or the like may be provided to prevent rotation of the beam. Bolts or pins may extend transversely into or through the beam and/or longitudinally intone or both ends of the beam. A plate or other projection attached to a second end of the beam may interface with another part of the coupling to prevent rotation of the beam.

Additional mechanisms or structures may be provided to support a beam in positional and/or rotational alignment with an aperture that receives an end of the beam when the beam is in its closed configuration. Such mechanisms or structures may include one or more guide surfaces or rollers that bear against the beam while allowing movement of the beam between its retracted and closed configurations.

The following are non-limiting enumerated example embodiments.

1. A coupling useful in overhead lifting, the coupling comprising:

a first member spaced apart from a second member by a gap dimensioned to receive a coupling member between them;

a beam supported in an aperture proximate an end of the first member; and the second member having an aperture or recess dimensioned to receive a first end of the beam, the beam movable longitudinally between a closed configuration wherein the beam spans the gap with the first end of the beam engaged in the aperture or recess on the second member and a retracted configuration wherein the first end of the beam is spaced apart from the second member such that the coupling member is insertable into the gap when the beam is in the retracted configuration and the coupling member is retained in the gap by the beam when the beam is in the closed configuration, the beam having a non-circular cross section wherein a depth of the beam is greater than a thickness of the beam and the beam is held against rotation relative to at least one of the first and second members.

2. A coupling according to example embodiment 1 wherein one or both of the aperture of the first member and the aperture or recess of the second member conform at least in part to the cross section of the beam and thereby restrict rotation of the beam.

3. A coupling according to example embodiment 1 or 2 wherein the beam comprises a depth to thickness ratio of at least 1.5 to 1.

4. A coupling according to any one of example embodiments 1 to 3 wherein the beam comprises a contact area configured to engage a corresponding contact surface of the coupling member wherein the contact area lies within the cross-section of the beam.

5. A coupling according to example embodiment 4 wherein the contact area has a compound curvature.

6. A coupling according to any one of example embodiments 1 to 5 comprising one or more guide surfaces configured to bear against the beam to align the beam with the aperture or recess of the second member.

7. A coupling according to any one of example embodiments 1 to 6 comprising a force amplifying mechanism connected to move the beam relative to the first and second members.

8. A coupling according to example embodiment 7 wherein the force amplifying mechanism comprises a screw and the beam comprises an opening into which the screw is threadedly engageable.

9. A coupling according to example embodiment 7 wherein the beam comprises one or more screws and the force amplifying mechanism comprises one or more openings or recesses into which the one or more screws are threadedly engageable.

10. A coupling according to example embodiment 9 wherein the one or more screws have a fixed amount of freedom for longitudinal movement relative to the beam.

11. A coupling according to any one of example embodiments 9 and 10 wherein the one or more screws comprise a plurality of screws and the coupling comprises a gear train coupling the plurality of screws to rotate in synchronously with one another.

12. A coupling according to example embodiment 7 wherein the force amplifying mechanism comprises first and second screws respectively extending longitudinally along first and second sides of the beam, each of the first and second screws coupled to rotate relative to the beam and first and second half-nuts supported relative to the first member and respectively engaging the first and second screws.

13. A coupling according to example embodiment 12 wherein each of the first and second screws have a longitudinal play relative to the beam of at least 1 cm.

14. A coupling according to example embodiment 12 or 13 wherein each of the first and second screws extends along a corresponding groove in the beam.

15. A coupling according to example embodiment 7 comprising an operating mechanism configured to apply force in a longitudinal direction to each of first and second sides of the beam, the operating mechanism mounted to the first member.

16. A coupling according to example embodiment 7 wherein the beam is movable between its closed and retracted configurations by a tool and the beam comprises a tool coupling for coupling to the tool.

17. A coupling mechanism according to example embodiment 16 wherein the tool comprises one or more drive screws dimensioned to threadedly engage one or more threaded openings or recesses in the first end of the beam.

18. A coupling according to any of example embodiments 1 to 6 comprising an actuation mechanism connected to move the beam between its closed and retracted configurations.

19. A coupling according to example embodiment 18 wherein the actuation mechanism comprises at least one selected from: a linear actuator, a rack and pinion mechanism, rack and worm mechanism, a hydraulic or pneumatic piston, and a lever.

20. A coupling according to any one of example embodiments 18 to 19 comprising a remote control mechanism for operating the actuation mechanism.

21. A coupling according to any one of example embodiments 1 to 20 wherein the beam comprises a marking which is visible only when the beam is not in the closed configuration.

22. A coupling according to any one of example embodiments 1 to 7 wherein the beam comprises an arcuate beam and the arcuate beam is movable in a curved path extending between the aperture of the first member and the aperture or recess of the second member.

23. A coupling according to example embodiment 1 wherein insertion of the coupling member actuates the movement of the beam from the retracted configuration to the closed configuration.

24. A coupling according to any one of example embodiments 1 to 23 wherein a yield strength of the beam is at least 110 kpsi.

25. A coupling according to any one of example embodiments 1 to 24 wherein the beam has an impact toughness of at least 31 ft-lb (42 J) at −40° F. (−40° C.) average.

26. A coupling according to any one of example embodiments 1 to 25 wherein the beam is coated with a nitride layer.

27. A coupling according to any one of example embodiments 1 to 26 in overhead lifting equipment in a drill rig wherein the coupling couples a top drive to an overhead hoisting member.

28. A coupling according to example embodiment 27 wherein the overhead hoisting member comprises a traveling block.

29. A coupling according to example embodiment 27 or 28 wherein the contact area has a configuration as specified by API standard 8C.

30. A coupling according to any one of example embodiments 27 to 29 wherein the first and second members comprise arms extending upwardly from the top drive.

31. A coupling according to example embodiment 28 or 29 wherein the first and second members comprise arms extending downwardly from the traveling block.

32. A coupling according to any one of example embodiments 27 to 29 wherein the first and second members comprise arms extending downwardly from a traveling block adapter.

33. A method for coupling in overhead lifting, the method comprising:

providing first and second members attached to a first element and a beam supported in an aperture proximate an end of the first member, the beam dimensioned to extend from the first member to contact an aperture or recess in the second member, the aperture or recess dimensioned to receive a first end of the beam;

actuating the beam to move from a retracted configuration in which a coupling member attached to a second element to be coupled to the first element is insertable into the gap to a closed configuration in which the beam spans the gap with the first end of the beam engaged in the aperture or recess on the second member such that the first and second elements are coupled together, wherein the beam has a non-circular cross section and the method comprises holding the beam against rotation relative to at least one of the first and second members.

34. A method according to example embodiment 33 wherein one of the first and second elements comprises a top drive.

35. A method according to example embodiment 34 wherein another one of the first and second elements comprises a traveling block.

36. A method according to example embodiment 35 wherein the first element is a top drive and the method comprises lowering the traveling block while the beam is in the retracted configuration to bring the coupling member into the gap between the first and second members.

37. A method according to any one of example embodiments 33 to 36 wherein at least one of the aperture of the first member and the aperture or recess of the second member conforms at least in part to the cross section of the beam and thereby prevents rotation of the beam in the apertures.

38. A method according to any one of example embodiments 33 to 37 wherein a depth of the beam is greater than a thickness of the beam.

39. A method according to example embodiment 38 wherein the beam comprises a depth to thickness ratio of at least 1.5 to 1.

40. A method according to any one of example embodiments 33 to 39 wherein the shape of the non-circular cross section is one of: rectangular with rounded corners, rectangular without rounded corners, oval, elliptical, or obround.

41. A method according to any one of example embodiments 33 to 40 wherein the beam comprises a contact area dimensioned to fit a contact surface of the coupling member and the method comprises engaging the contact surface of the beam with the contact surface of the coupling member.
42. A method according to example embodiment 41 wherein the contact area lies within the cross-section of the beam.
43. A method according to any one of example embodiments 33 to 42 wherein the beam has a yield strength of at least 110 kpsi.
44. A method according to any one of example embodiments 33 to 43 wherein the beam has an impact toughness of at least 31 ft-lb (42 J) at −40° F. (−40° C.) average.
45. A method according to any one of example embodiments 33 to 44 comprising providing a nitride layer on the beam.
46. A method according to any one of example embodiments 33 to 45 wherein actuating the beam comprises manually actuating the beam.
47. A method according to example embodiment 46 wherein manually actuating the beam comprises using a tool to move the beam between the closed configuration and the retracted configuration.
48. A method according to any one of example embodiments 33 to 47 wherein actuating the beam comprises using a force-amplifying mechanism to move the beam between the retracted configuration and the closed configuration.
49. A method according to example embodiment 48 wherein the force-amplifying mechanism comprises a drive screw dimensioned to be threaded into a threaded opening at one end of the beam and an actuation mechanism for driving the drive screw in and out of the threaded opening.
50. A method according to example embodiment 48 wherein the beam comprises one or more drive screws dimensioned to be threaded into one or more threaded openings or recesses at one end of the force-amplifying mechanism and an actuation mechanism for driving the one or more drive screws in and out of the one or more threaded openings or recesses.
51. A method according to example embodiment 50 wherein the one or more screws have a fixed amount of freedom for longitudinal movement relative to the beam.
52. A method according to any one of example embodiments 50 and 51 wherein the one or more screws comprise a plurality of screws and the method comprises rotating the plurality of screws synchronously with one another.
53. A method according to example embodiment 52 comprising actuating the beam using a mechanism comprising at least one of a linear actuator, a rack and pinion mechanism, rack and worm mechanism, a hydraulic piston, a motor, or a lever.
54. A method according to any one of example embodiments 33 to 53 comprising guiding the beam to align the beam with the aperture of the first member and the aperture or recess of the second member.
55. A method according to any one of example embodiments 33 to 53 comprising actuating the beam remotely with a remote control mechanism.
56. A method according to any one of example embodiments 33 to 55 wherein the beam comprises a marking which is visible only when the beam is not in the closed configuration.
57. A method according to any one of example embodiments 33 to 56 wherein the beam comprises an arcuate beam and actuating the arcuate beam comprises actuating the arcuate beam to follow a curved path between the aperture of the first member and the aperture or recess of the second member.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a fastener, member, screw, actuator, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A coupling useful in overhead lifting, the coupling comprising:

a first member spaced apart from a second member by a gap dimensioned to receive a coupling member between them;

a beam supported in an aperture proximate an end of the first member; and the second member having an aperture or recess dimensioned to receive a first end of the beam, the beam movable longitudinally between a closed configuration wherein the beam spans the gap with the first end of the beam engaged in the aperture or recess on the second member and a retracted configuration wherein the first end of the beam is spaced apart from the second member such that the coupling member is insertable into the gap when the beam is in the retracted configuration and the coupling member is retained in the gap by the beam when the beam is in the closed configuration, the beam having a non-circular cross section wherein a depth of the beam is greater than a thickness of the beam at least in a portion of the beam that is in the gap when the beam is in the closed configuration and the beam is held against rotation relative to at least one of the first and second members wherein the beam comprises a contact area configured to engage a corresponding contact surface of the coupling member and, when the beam is viewed end-on, the contact area lies within the cross-section of the beam.

2. A coupling according to claim 1 wherein the beam comprises a depth to thickness ratio of at least 1.5 to 1.

3. A coupling according to claim 2 wherein a yield strength of the beam is at least 110 kpsi.

4. A coupling according to claim 2 wherein the beam has an impact toughness of at least 31 ft-lb (42 J) at −40° F. (−40° C.) average.

5. A coupling according to claim 2 wherein the beam is coated with a nitride layer.

6. A coupling according to claim 2 wherein one or both of the aperture of the first member and the aperture or recess of the second member conform at least in part to the cross section of the beam and thereby restrict rotation of the beam.

7. A coupling according to claim 1 wherein the contact area has a compound curvature.

8. A coupling according to claim 7 comprising one or more guide surfaces configured to bear against the beam to align the beam with the aperture or recess of the second member.

9. A coupling according to claim 1 comprising a force amplifying mechanism connected to move the beam relative to the first and second members.

10. A coupling according to claim 9 wherein the force amplifying mechanism comprises a screw and the beam comprises an opening into which the screw is threadedly engageable.

11. A coupling according to claim 9 wherein the beam comprises one or more screws and the force amplifying mechanism comprises one or more openings or recesses into which the one or more screws are threadedly engageable.

12. A coupling according to claim 11 wherein the one or more screws have a fixed amount of freedom for longitudinal movement relative to the beam.

13. A coupling according to claim 11 wherein the one or more screws comprise a plurality of screws and the coupling comprises a gear train coupling the plurality of screws to rotate in synchrony with one another.

14. A coupling according to claim 9 wherein the force amplifying mechanism comprises first and second screws respectively extending longitudinally along first and second sides of the beam, each of the first and second screws coupled to rotate relative to the beam and first and second half-nuts supported relative to the first member and respectively engaging the first and second screws.

15. A coupling according to claim 14 wherein each of the first and second screws have a longitudinal play relative to the beam of at least 1 cm.

16. A coupling according to claim 14 wherein each of the first and second screws extends along a corresponding groove in the beam.

17. A coupling according to claim 9 comprising an operating mechanism configured to apply force in a longitudinal direction to each of first and second sides of the beam, the operating mechanism mounted to the first member.

18. A coupling according to claim 9 wherein the beam is movable between its closed and retracted configurations by a tool and the beam comprises a tool coupling for coupling to the tool.

19. A coupling mechanism according to claim 18 wherein the tool comprises one or more drive screws dimensioned to threadedly engage one or more threaded openings or recesses in the first end of the beam.

20. A coupling according to claim 1 comprising an actuation mechanism connected to move the beam between its closed and retracted configurations.

21. A coupling according to claim 20 wherein the actuation mechanism comprises at least one selected from: a linear actuator, a rack and pinion mechanism, rack and worm mechanism, a hydraulic or pneumatic piston, and a lever.

22. A coupling according to claim 20 comprising a remote control mechanism for operating the actuation mechanism.

23. A coupling according to claim 1 wherein the beam comprises a marking which is visible only when the beam is not in the closed configuration.

24. A coupling according to claim 1 wherein the beam comprises an arcuate beam and the arcuate beam is movable in a curved path extending between the aperture of the first member and the aperture or recess of the second member.

25. A coupling according to claim 1 wherein insertion of the coupling member actuates the movement of the beam from the retracted configuration to the closed configuration.

26. A coupling according to claim 1 in combination with overhead lifting equipment in a drill rig wherein the coupling couples a top drive to an overhead hoisting member.

27. A coupling combination according to claim 26 wherein the overhead hoisting member comprises a traveling block.

28. A coupling combination according to claim 26 wherein the beam comprises a contact area configured to engage a corresponding contact surface of the coupling member and the contact area has a configuration as specified by API Specification 8C (fifth edition).

29. A coupling combination according to claim 26 wherein the first and second members comprise arms extending upwardly from the top drive.

30. A coupling combination according to claim 27 wherein the first and second members comprise arms extending downwardly from the traveling block.

31. A coupling combination according to claim 26 wherein the first and second members comprise arms extending downwardly from a traveling block adapter.

* * * * *